US006460306B1

(12) United States Patent
Nelson

(10) Patent No.: US 6,460,306 B1
(45) Date of Patent: Oct. 8, 2002

(54) INTERCONNECTING DISENGAGEABLE FLOORING SYSTEM

(75) Inventor: Thomas John Nelson, Belton, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 0 days.

(21) Appl. No.: 09/436,317

(22) Filed: Nov. 8, 1999

(51) Int. Cl.[7] ..... E04B 2/00

(52) U.S. Cl. ..... 52/582.1; 52/570; 52/581; 52/588.1; 52/586.2

(58) Field of Search ..... 52/570, 581, 588.1, 52/582.1, 586.2

(56) References Cited

U.S. PATENT DOCUMENTS

| | | | |
|---|---|---|---|
| 1,430,996 | A | 10/1922 | Horlin |
| 1,916,748 | A | 7/1933 | Wright |
| 2,000,226 | A | 5/1935 | Fry ..... 91/68 |
| 2,142,305 | A | 1/1939 | Davis |
| 2,204,675 | A | 6/1940 | Grunert |
| 2,430,200 | A | 11/1947 | Wilson |
| 2,453,918 | A | 11/1948 | Jansen |
| 2,671,538 | A | 3/1954 | Horowitz et al. |
| 2,740,167 | A | 4/1956 | Rowley |
| 2,996,751 | A | 8/1961 | Roby et al. |
| 3,100,556 | A | 8/1963 | DeRidder |

(List continued on next page.)

FOREIGN PATENT DOCUMENTS

| | | |
|---|---|---|
| CA | 759196 | 5/1967 |
| CH | 562 377 A | 5/1975 |
| DE | 200949 | 1/1939 |
| DE | 1714532 | 1/1956 |
| DE | 2 159 042 | 6/1973 |
| DE | 1 534 278 | 12/1973 |
| DE | 2502992 | 1/1975 |
| DE | 26 16 077 A1 | 4/1976 |
| DE | 304178 A1 | 11/1980 |
| DE | 30 41 781 A | 6/1982 |
| DE | 3343601 | 2/1983 |
| DE | 33 43 601 A | 6/1985 |
| DE | 3544845 A1 | 12/1985 |

(List continued on next page.)

OTHER PUBLICATIONS

EPO communication dated Jun. 28, 2000.

Kuegele, Duo Grip, the Fastening Solution for Parquet and Laminate, M.A. Kuegle, Ges.m.b.H, P.O. Box 55–A–1104 Vienna, Austria.

Kuegele Profiles for Laminate and Parquet, M.A. Kuegle Ges.m.b.H., P.O. Box, A–1104, Vienna, Austria.

EP 01 11 9869 Search Report dated Oct. 12, 2001.

EP 01 11 9907 European Search Report dated Oct. 12, 2001.

PCT/SE 99/01699 International Searc Report dated Jan. 17, 2000.

*Primary Examiner*—Beth A. Stephan
*Assistant Examiner*—Dennis L. Dorsey
(74) *Attorney, Agent, or Firm*—Baker Botts L.L.P.

(57) ABSTRACT

The present invention relates to a disengageable interconnecting flooring system for use in forming a temporary or permanent flooring surface on top of a support structure from individual flooring panels. The system includes two or more flooring panels comprising a top wear surface and a bottom surface for contact with the support structure. The panels have at least three edges and all edges have recesses formed therein. The system further comprises a connector having a base and a projection extending vertically from the base. The projection extending from the base is shaped to be received in a disengageable vertical connected fashion into the recesses of the panels. Preferably, the connector is comprised of a base having a projection extending the entire length thereof. In a preferred embodiment, the connector and panels further comprise means for connecting the panels in a disengageable horizontal fashion.

31 Claims, 18 Drawing Sheets

U.S. PATENT DOCUMENTS

| | | | | |
|---|---|---|---|---|
| 3,111,205 | A | 11/1963 | Gresham | |
| 3,128,851 | A | 4/1964 | DeRidder et al. | |
| 3,182,769 | A | 5/1965 | DeRidder | |
| 3,310,919 | A | 3/1967 | Bue et al. | |
| 3,381,436 | A | 5/1968 | Elliott et al. | |
| 3,385,182 | A | 5/1968 | Harvey | |
| 3,508,369 | A | 4/1970 | Tennison | |
| 3,526,420 | A | 9/1970 | Brancaleone | |
| 3,538,665 | A | 11/1970 | Gohner | |
| 3,570,205 | A | 3/1971 | Payne | |
| 3,590,545 | A | 7/1971 | Webb | |
| 3,657,852 | A | 4/1972 | Worthington et al. | |
| 3,688,460 | A | 9/1972 | Van Loghem et al. | |
| 3,694,983 | A | 10/1972 | Couquet | |
| 3,823,525 | A | 7/1974 | Brunn | |
| 3,859,000 | A | 1/1975 | Webster | |
| 3,889,320 | A | 6/1975 | Koscik | |
| 3,947,614 | A | 3/1976 | Becker | 427/284 |
| 3,967,581 | A | 7/1976 | Zirbel | 118/2 |
| 4,067,155 | A | 1/1978 | Ruff et al. | |
| 4,069,731 | A | 1/1978 | Stang | |
| 4,070,987 | A | 1/1978 | Gross et al. | 118/257 |
| 4,074,655 | A | 2/1978 | Gross et al. | 118/410 |
| 4,125,984 | A | 11/1978 | Jonas | |
| 4,135,339 | A | 1/1979 | Pawlitschek | |
| 4,226,064 | A | 10/1980 | Kraayenhof | |
| 4,226,662 | A | 10/1980 | McCort | 156/390 |
| 4,296,582 | A | 10/1981 | Simpson et al. | |
| 4,333,417 | A | 6/1982 | Camp et al. | 118/50 |
| 4,385,850 | A | 5/1983 | Bobath | |
| 4,405,272 | A | 9/1983 | Wollar | |
| 4,407,618 | A | 10/1983 | Kimura | |
| 4,426,820 | A | 1/1984 | Terbrack et al. | |
| 4,449,346 | A | 5/1984 | Tremblay | |
| 4,461,131 | A | 7/1984 | Pressell | |
| 4,599,842 | A | 7/1986 | Counihan | 52/586 |
| 4,648,231 | A | 3/1987 | Laroche | |
| 4,653,138 | A | 3/1987 | Carder | |
| 4,741,136 | A | 5/1988 | Thompson | |
| 4,769,963 | A | 9/1988 | Meyerson | |
| 4,796,402 | A | 1/1989 | Pajala | |
| 4,841,907 | A | 6/1989 | Otsuka | 118/669 |
| 4,845,907 | A | 7/1989 | Meek | |
| 4,857,367 | A | 8/1989 | Thorn et al. | 427/348 |
| 4,905,442 | A | 3/1990 | Daniels | |
| 4,917,532 | A | 4/1990 | Haberhauer et al. | |
| 5,022,200 | A | 6/1991 | Wilson et al. | |
| 5,085,891 | A | 2/1992 | Evans | 427/277 |
| 5,086,599 | A | 2/1992 | Meyerson | |
| 5,157,890 | A | 10/1992 | Jines | |
| 5,179,812 | A | 1/1993 | Hill | |
| 5,182,891 | A | 2/1993 | Slocum | 52/480 |
| 5,274,979 | A | 1/1994 | Tsai | |
| 5,295,341 | A | 3/1994 | Kajiwara | |
| 5,298,072 | A | 3/1994 | Schiele et al. | 118/681 |
| 5,332,073 | A | 7/1994 | Quigley et al. | |
| 5,348,778 | A | 9/1994 | Knipp et al. | |
| 5,349,796 | A | 9/1994 | Meyerson | |
| 5,497,589 | A | 3/1996 | Porter | |
| 5,622,012 | A | 4/1997 | Schijf | |
| 5,641,255 | A | 6/1997 | Tanaka | |
| 5,706,621 | A | 1/1998 | Pervan | |
| 5,706,623 | A | 1/1998 | Brown | |
| 5,736,227 | A | 4/1998 | Sweet et al. | |
| 5,772,762 | A | 6/1998 | Hanitzsch | 118/203 |
| 5,860,266 | A | 1/1999 | Martinet | |
| 5,882,409 | A | 3/1999 | Stahl | 118/712 |
| 6,006,486 | A | 12/1999 | Moriau et al. | |
| 6,023,907 | A | 2/2000 | Pervan | |
| 6,089,805 | A | 7/2000 | Salmon | |
| 6,094,882 | A | 8/2000 | Pervan | 52/745.19 |
| 6,101,778 | A | 8/2000 | Mårtensson | 52/582.1 |
| 6,134,854 | A | 10/2000 | Stanchfield | 52/480 |
| 6,182,410 | B1 | 2/2001 | Pervan | 52/403.1 |
| 6,205,639 | B1 | 3/2001 | Pervan | 29/509 |

FOREIGN PATENT DOCUMENTS

| | | | | |
|---|---|---|---|---|
| DE | 86 04 004 | | 4/1986 | |
| DE | 3631 390 | A1 | 12/1987 | E04F/15/04 |
| DE | 3635167 | | 4/1988 | |
| DE | 42 42 530 | A1 | 12/1992 | |
| DE | 295 20 966 | U1 | 2/1995 | |
| DE | 197 13 542 | A1 | 10/1998 | |
| EP | 0 558 767 | A1 | 12/1991 | |
| EP | 0 519 856 | A1 | 12/1992 | |
| EP | 42 42 530 | A1 | 6/1994 | |
| EP | 0 696 667 | A1 | 2/1996 | |
| EP | 0 839 974 | A1 | 5/1998 | |
| EP | 0839974 | A3 | 8/1998 | |
| EP | 0 855 482 | B1 | 12/1999 | E04F/15/14 |
| EP | 0 877 130 | B1 | 1/2000 | E04F/15/14 |
| EP | 0 969 164 | A2 | 1/2000 | E04F/15/04 |
| FR | 531202 | | 9/1954 | |
| FR | 1293043 | | 4/1962 | |
| FR | 2 108 402 | | 4/1972 | |
| FR | 2 568 295 | | 1/1986 | |
| FR | 2697275 | | 10/1992 | |
| FR | 2 697 275 | A1 | 4/1994 | |
| GB | 424057 | | 7/1934 | |
| GB | 1275511 | | 5/1972 | |
| GB | 1 430 423 | | 3/1976 | |
| GB | 2117813 | A | 3/1983 | |
| GB | 2 117 813 | A | 10/1983 | |
| GB | 2 126 106 | | 3/1984 | |
| GB | 2 175 680 | A | 12/1986 | |
| GB | 2256023 | A | 5/1991 | |
| GB | 2257040 | A | 1/1993 | |
| GB | 2 257 040 | | 6/1993 | |
| HU | 214470 | B | 4/1994 | E04F/15/14 |
| IT | 519890 | | 3/1955 | |
| JP | 56-5347 | | 1/1981 | |
| JP | 57 119056 | | 7/1982 | |
| JP | 1-306911 | | 11/1989 | |
| JP | 3 169967 | | 7/1991 | |
| NO | 157871 | | 12/1983 | |
| SE | 7114900-9 | | 5/1973 | |
| SE | 372 051 | | 12/1974 | |
| SE | 8206934-5 | | 6/1984 | |
| WO | WO 84/02155 | | 6/1984 | |
| WO | WO 86/05754 | | 10/1986 | |
| WO | WO 90/00656 | | 1/1990 | |
| WO | WO 93/13280 | | 7/1993 | |
| WO | WO 9404773 | | 3/1994 | |
| WO | WO 94/26999 | | 11/1994 | |
| WO | WO 96/06241 | | 2/1996 | |
| WO | WO 97/21011 | | 6/1997 | |
| WO | WO97/21011 | | 6/1997 | |
| WO | WO 97/47834 | | 12/1997 | |
| WO | WO 00/20705 | | 4/2000 | |
| WO | WO 00/20706 | | 4/2000 | |

INTERCONNECTING DISENGAGEABLE FLOORING SYSTEM

FIELD OF THE INVENTION

The present invention relates to flooring surfaces, preferably decorative flooring surfaces. In addition, the present invention relates to a system for constructing a flooring surface, e.g., a decorative flooring surface. More specifically, the present invention relates to thin laminate flooring surfaces comprising a top wear surface, preferably decorative in nature, a substrate reinforcing material or layer, and optionally, a backing material or layer. The present invention also relates to components, systems, and methods for constructing a disengageable decorative laminate flooring surface from individual flooring panels. In addition, the present invention relates to decorative laminate flooring products or components, e.g., panels and elements for connecting the panels.

BACKGROUND OF THE INVENTION

Various systems have been proposed in an attempt to provide a means for easily constructing a flooring surface; however, none to date have found overwhelming acceptance in the market place, especially in relation to disengageable thin laminate "floating floor" surfaces. A number of the known proposed systems are discussed to provide a background for the present invention.

U.S. Pat. No. 3,310,919 titled "Portable Floor," discloses a floor comprising a plurality of like panels having straight sides, coupling elements at said sides for coupling arrangement with cooperating coupling elements on adjacent panels, and means operatively associated with said coupling elements for releasably locking adjacent panels in a side-by-side contiguous relationship. As illustrated in FIG. 2, the panels are coupled together using locking screws 19 and nails 15.

U.S. Pat. No. 3,657,852 titled "Floor Tiles," discloses a floor or tile consisting either of a single piece composed of any one of a range of different materials or a plurality of superimposed laminations each composed of any one of a range materials. The floor tiles are formed with a plurality of identical, laterally projecting tongues and, in their underside, with an equal number of identical pockets which open to the periphery of the tiles and alternate around the periphery with the tongues. The tongues and pockets being so shaped that any tongue of any one of the tiles is adapted to engage and fit within any pocket of any one of the other tiles and when so engaged, it is held against endwise withdrawal from the pocket so that, when the two tiles are located in a common plane, relative movement there between in said plane is prevented.

U.S. Pat. No. 4,449,346 titled "Panel Assembly," discloses a panel assembly including at least two panels and a connector member for mounting the panels to a support surface, the panels being positioned edge-to-edge in coplanar relationship with the respective confronting edges thereof spaced apart, and the connector member between the confronting panel edges and interlocking the panels together by being fixedly secured to the support surface. Each panel has first and second surfaces in first and second parallel planes and each has on its respective edge a tongue and a groove. The tongue and groove extend along the panel edge in between the first and second planes, and respectively project an opening outwardly angularly towards the first plane. The connector member comprises an elongated body filing the space between the confronting panel edges and having on each side thereof a tongue and a groove respectively projecting an opening outwardly angularly towards the second plane. The tongue and groove on either side are complimentary to lockingly engage with the respective groove and tongue on the adjacent respective confronting edges of the panel. The connector member cooperates with the panels to urge the panels toward one another in a tight locking engagement as a result of a compressive force being exerted on the member in the direction toward the support surface when the member is secured to the support surface. The patent states that the provision of such a connector member does away with the heretofore known practice of driving nails or screws in the panel edges to fix the panels to the support surface, while still providing a tight locking engagement between the panels. As shown in FIG. 2, the connecting member is fixedly secured to the support surface using screw 86. In addition, "the top surface 56 of the connector member 14 is coplanar with the top planar surfaces 16 and 18 of panels 10 and 12" and therefore, forms a part of the top wear surface—which is readily visible.

U.S. Pat. No. 4,135,339 titled "Slatted Floor System," discloses a slatted floor system which is said to be easily assembled, provides film footing and comfort to confined animals, resists corrosion, discourages accumulation of animal waste, is easily cleaned, and can be used to span significantly greater distances than prior art slats. The slatted floor system is stated to comprise a plurality of elongated, spaced, generally parallel slats. Each slat has a top, load-carrying surface with spaced apart, opposite outer edges. Each slat also has a bottom surface substantially parallel to the top surface and a pair of side surfaces integral with the top surface and the bottom surface. The side surfaces are joined with the top surface along lines recessed from the outer edges of the top surface. The side surfaces are said to further taper toward each other in first positions, adjacent to the top surface, then extend substantially parallel to each other and vertically relative to the bottom surface in second portions. It is stated that this forms with the top and bottom surfaces a generally Y-shaped, enclosed main compartment. The patent discloses that each slat also includes a first pair of projection receiving means extending longitudinally along the tapered first portion of its side surfaces and a second pair of projection receiving means extending longitudinally along the second portion of the side surfaces. Adjacent slats are said to be connected and locked in spaced-apart relationship in a plurality of connectors. Each connector has a pair of projections, with each projection being receivable by one of the first pair of projection receiving means on each of two adjacent slats, and the second pair of projection receiving means on each of two adjacent slats. At least one of the first and second pairs of projections on the connectors are adapted to interlock with its corresponding projection receiving means on adjacent slats. As stated above, and shown in FIGS. 1 and 4, the upper wear surface of the slats are spaced apart to provide a gap to facilitate the object of the invention, ie., for discouraging the accumulation of animal waste. In addition, as shown in the same figures, the projections and connector means can only be assembled by sliding the edges of the slats and connector together when held in parallel coplanar relationship to one another. And as shown, the connector member does not extend the entire length of the slat members.

U.S. Pat. No. 4,461,131 titled "Panel Interconnection System," discloses an assembly of panels of rectangular shape, as for example, a floor, in which the panels comprise upper and lower ridged sheets separated by a core, elongated fittings extending along adjacent edges of adjacent panels and having lateral extension receipt means between edge portions of the sheets of the panels. Each fitting has an upwardly open channel located beyond the edge of the associated panel. Adjacent fittings and adjacent panels are secured together by elongated connector strips which have parallel elongated lugs received in the channels of the adjacent fittings. As shown in FIG. 3, strips 40 form a portion of the top wear surface and are thus, visibly distinct from the upper surface 10 of flooring panels P.

U.S. Pat. No. 4,796,402 titled "Step Silencing Parquet Floor," discloses a step silencing parquet board, in which the sound of steps which are perceivable from one room to another are silenced by using a surface-press non-homogeneous fiber board in the supporting construction layers provided underneath the wear surface layer of the parquet board. The patent discloses that the board has longitudinal sides and ends formed with a tongue and groove whereby said board will cooperate with adjacent boards to form a self-silencing parquet floor.

U.S. Pat. No. 5,022,200 titled "Interlocking Sections for Portable Floors and the Like," discloses an alleged improved locking mechanism including first and second members which fit together for locking purposes. The second locking member has pins mounted therein for motion along defined paths between first and second positions, referred to in the patent as closed and open positions. The patent discloses means for normally urging the pins to their closed positions. The first locking member is stated to have means for moving the pins to their open positions when the two lock members are moved together and for permitting the pins to return to their closed positions after engagement of the first and second lock members. The first lock member has engagement surfaces which contact the pins when forces are applied to move the first and second lock members apart. The shape or slope of these engagement surfaces relative to the paths of the defined motion of the pins is such as to cause substantial interference of the first lock member with the pins which prevents movement of the pins to the open position and therefore, prevents removal of the lock member. A separate unlocking mechanism is provided to move the pins to the open position and thereby permit disengagement of the mechanism. According to a preferred embodiment disclosed in the patent, the first locking member includes a flange and the second locking member includes means to define a recess to receive the flange. The pins are positioned generally within the receiving space, and the flange includes surfaces on its outer edge for moving the pins to the open position, and hook-like portions having engagement surfaces which engage the pins in a locked position. The patent also discloses an alleged improved panel construction wherein a panel is formed in a single molding process which encapsulates a core member in urethane, molds the edge tongue and groove portions with recesses formed therein to receive the locking members, and bonds the decorative endurable floor surface.

U.S. Pat. No. 5,157,890 titled "Floor," discloses a flooring system of individual panel assemblies that may be cooperatively interengaged. The patent discloses that the periphery of each panel is bound by frame members having two spaced generally parallel flanges and a generally perpendicular web extending therebetween. On one side of the web, between the upper and lower flanges, the frame members include a track for receiving a key block. The key block comprises a generally rectangular base with a key tongue extending therefrom. The base is slottably received in the track of one frame member and the tongue is received in the track of an adjacent frame member. The frame members may be miter cut to a desired length and the corners fastened together by a corner fastener U.S. Pat. No. 5,179,812 titled "Flooring Product," discloses a flooring product comprising a wood panel having an L-shaped surround the base of which is located below the wood panel. The patent discloses the use of a plurality of parallel aluminum battens which are connected to the base of the panel. These battens are said to comprise a groove. In practice, the patent discloses that two flooring products having similar joint arrangements are secured together by locating the base of the surround of each product in the groove and the elongated members of the other product. The connection cannot be disengaged unless one of the flooring panels is tilted relative to the other.

U.S. Pat. No. 5,295,341 titled "Snap-Together Flooring System," discloses a flooring system having a base member having a top side, an underside, and four circumferentially spaced outer edges, a tongue connector secured to one outer edge by an interlocking rib and groove, a groove connector secured to another outer edge by an interlocking rib and groove, a tongue connector having forwardly converging compressible side walls terminating in rear transverse locking surfaces, the groove connector having a large inner opening and a small outer opening. The tongue sidewalls in a compressed position being smaller than said groove outer opening to pass through the outer opening but elastically expandable to be larger than said outer opening to lock a tongue and a groove. The patent discloses that preferably the connectors are attached to the base members and recesses of the outer edges by additional tongues and grooves and that they are attached to the base members at the factory during manufacture U.S. Pat. No. 5,736,227 titled "Laminated Wood Flooring Product and Wood Floor," discloses a flooring product which includes a top decorative layer, an intermediate layer bonded to the top layer, and a base layer bonded to the intermediate layer. The top, intermediate, and base layers are bonded to define a laminated elongated wood flooring strip. A tongue and groove are formed on respective side edges of the flooring strip. The tongue and groove extend along the length of the flooring strip, and lock adjacent flooring strips together side-to-side to form an assembled wood floor. The base layer has a multiplicity of closely spaced-apart scores cut transverse to the length of the flooring strip along substantially the entire length of the flooring strip. The scores relieve stress and increase flexibility in the wood strip for more closely adhering to irregularities of the sub floor.

U.S. Pat. No. 3,694,983 titled "Pile or Plastic Tiles for Flooring and the Like Applications," discloses tiles adapted to constitute by juxtaposition a continuous, plain or diversified carpet or revetment of textile, plastic or other material. Each tile is secured to a backing of the same dimensions but having projections along two adjacent edges of the tile to form an embedded strip. Each strip is provided with means permitting the mutual engagement of fastening means provided in embedded condition under the edges of two sides of the adjacent tile. The fastening means have a thickness inferior to that of said backing so that in assembled condition no extra thickness is produced in relation to the normal backing thickness.

U.S. Pat. No. 3,859,000 titled "Road Construction and Panel for Making Same," discloses a road construction comprised of a plurality of identical invertible polygonal panels. Each panel comprises a plurality of single piece peripheral frame members fixed together to define a polygonal configuration and each of the members having a roughly L-shaped projection extending therefrom. The projection is adapted to be interlocked with an identical projection of an associated member. Each panel also has a pair of load carrying sheets fixed on opposite sides of its frame members.

U.S. Pat. No. 5,706,621 titled "System for Joining Building Boards," discloses a system for laying and mechanically joining building panels, especially thin, hard, floating floors. The patent discloses that adjacent joint edges of two panels engage each other to provide a first mechanical connection locking the joint edges in a first direction perpendicular to the principal plane of the panels. In each joint, the patent states that there is provided a strip which is integrated with or integrally formed with one joint edge and which projects behind the other joint edge. The patent discloses that the strip has upwardly protruding locking elements engaging in a locking groove in the rear side of the other joint edge to form a second mechanical connection locking the panels in a second direction parallel to the principal plane of the panels and at right angles to the joint. Both the first and second mechanical connections allow mutual displacement of joined panels in the direction of the joint. The patent discloses that the strip is mounted at the factory on the underside of the panel and extends throughout the joint edge. The patent discloses the strip may be made of flexible, resilient aluminum, and can be affixed mechanically, by means of glue or any other suitable way. The patent discloses that alternatively, the strip may be integrally formed with the strip panel. According to the patent, "at any rate, the strip 6 should be integrated with the panel 1, i.e., it should not be mounted on the strip panel in connection with laying."

U.S. Pat. No. 5,860,266 titled "Method for Joining Building Boards," discloses a method for laying and mechanically joining rectangular building panels in parallel rows. The patent discloses the following steps: (a) placing a new one of the panels adjacent to a long edge of a previously laid first panel in a first row and to a short edge of a previously laid second panel in an adjacent second row, such that the new panel is in the second row while holding the new panel at an angle relative to a principal plane of the first panel, such that the new panel is spaced from its final longitudinal position relative to the second panel and such that the long edge of the new panel is provided with a locking groove which is placed in contact with a locking strip at the adjacent long edge of the first panel; (b) subsequently angling down the new panel so as to accommodate a locking element of the strip of the first panel in a locking groove of the new panel, whereby the new panel and the first panel are mechanically connected with each other in a second direction with respect to the thus connected long edges, wherein the long edges, and the angled down position of the new panel, are engaged with each other and thereby mechanically locked together in a first direction also; and (c) displacing one of the new panels in its longitudinal direction relative to the first panel towards a final longitudinal position and to a locking element of one of the short edges of the new panel and the second panel snaps up into a locking groove of the other one of the short edges, whereby the new panel and the second panel are mechanically connected with each other in both the first and second directions with respect to the connected short edges. The patent states that the strip 6 projects horizontally from a panel and is mounted at the factory on the underside of the panel and extends the entire edge of the panel. The patent discloses that strip 6 may be made of flexible, resilient sheet aluminum, and can be affixed mechanically, by means of glue or any other suitable way. The patent discloses that other strip material can be used, such as sheets of other metals, as well as aluminum or plastic sections. Alternatively, the patent teaches that the strip 6 may be integrally formed with the strip panel. The patent states that "at any rate, the strip 6 should be integrated with a strip panel, i.e., it should not be mounted on the strip panel in connection with laying."

Japanese Patent Application No. 56-5347 titled "A Method for Partially Recovering Floor Plates," discloses floor plates laid on a floor bed with tongue joints engaged with groove joints. The patent teaches a saw is inserted into gap A between both the side floor plates of a floor plate to be replaced and the tongue joints are cut off, thereby connection between the floor plates is cut and the floor plate to be replaced is removed. The patent teaches that the subsequently left tongue joints in the groove joints of the adjacent floor plates are removed. The portion where there were tongue joints before in the floor plates is cut off and groove joints are newly formed. The patent states that FIG. 4 shows a new floor plate and that along both sides of the floor plate are formed relatively shallow and wide slots in relatively deep concaved portions. The bottom of the concaved portion is dented so as to hold a foaming synthetic resin. The new floor plate is then inserted into the position where the removed floor plate was located and at a status wherein the new floor plate is level with the adjacent floor plate. The foaming resin is foamed and hardened. The hardened foaming resin expands into the groove joints to form a tongue joint. It is also noted that the new floor plate in contact with the floor bed is secured by adhesive.

Japanese Patent Application No. 1-30691 titled "Floor Plates," discloses floor plates to be laid on a ground floor characterized by having a thin wooden decorative plate laminated onto the surface layer of a base material in a sheet shape. An engaging protrusion is formed on one side of the base material while an engaging concave portion to which the above engaging protrusion may be engaged is formed on the other end thereof, while an engaging concave portion to which the above engaging protrusion may be engaged is formed on the end of the other side thereof The patent teaches that the floor plates include a stopper protrusion formed on one side of the engaging protrusion and on one side of the engaging concave portion. And a stopper concave portion to which the stopper protrusion is engaged is formed on the other side of the engaging protrusion and on the other side of the engaging concave portion.

Patentschrift No. 200949 discloses in FIGS. 1 and 2 flooring panels having four edges wherein two edges include an upper groove for insertion thereunder of an adjacent panel, while the other two edges include an extension including a tooth formed to be inserted under the upper groove portion of an adjacent panel when assembled.

Patentschrift No. 1 534 278 discloses in FIGS. 1–3 to assemble two adjacent structures wherein the first structure includes a groove and a notch for receipt of a corresponding tongue and tooth of an adjacent structure to be connected thereto.

Offenlegungsschrift 25 02 992 discloses a flooring panel especially suitable for use in making a temporary floor, as for example, in a camping tent. The flooring panel is disclosed to have a flat thread surface bent back on at least two edges, one of which is given a distinct profile and the other having a fitting counterprofile. The patent teaches that these bent sections are preferably on two opposite sides, one being roughly U-shaped with its outer shank and the resultant slot-type opening facing upwards and the counterprofile consisting of a shank at right angles to the thread surface. The patent teaches that such profiles may be provided alternatively, on all four edges of the panel. It is disclosed that the panels may be of plastic, and formed in a single piece, corrugated projections underneath preferably of a softer material. As shown in FIG. 3, the panels are assembled together using a tongue and groove arrangement.

Offenlegungsschrift DE 3041781A1 discloses the inner connection of two panels wherein the panels include a tongue on one edge and a groove in another edge to provide interlocking connections between two panels used especially for constructing a skating rink or skittle alley. The patent discloses at the root of the tongue there are two parallel sides with faced pieces aligned at right angles to the edge of equal thickness. The patent discloses that the groove has two initial parallel sidewalls against which the tongue side face pieces come to rest. It is disclosed that this part of the groove is succeeded by a semi-trapezoidal shaped recess or a fully trapezoidal shaped recess. The patent discloses that the tongue may be rounded on the side opposite to its acute-angled side face.

Offenlegungsschrift DE 35 44 845 A1 discloses a board used for the manufacture of solid wood panels which consists of glued boards engaging complimentary profiles. Longitudinal edges of the boards have a joint profile which sections extend at an angle to the vertical board edge. The application discloses that the joint profile has two parallel straight sideward displaced upright flanks which are connected at their inner ends via straight transverse flanks. The inward upward flank encloses an acute angle with the board surface, while the other flank forms an obtuse angle with the associated board surface. Upright flanks and transverse flanks enclose acute angles.

European Patent Application No. 0248127 titled "A Table Top for a Motor Lorry,"discloses a motor lorry table top consisting of a plurality of planks which are fixed to at least two beams forming part of the motor lorry chassis. The planks consist of extruded aluminum and are fixed to the chassis by means of clips with the planks interlocking to secure the planks from relative movement therebetween.

Patenttihakemus-Patentansokan 843067 (PCT/SE 83/00423) discloses a means for interconnecting adjacent panels wherein the edges of panels to be connected include tongues and grooves. In addition, located to either side of the tongue and groove joint of two connected panels are recesses formed in said panels for receipt of a U-shaped metal clamp means for holding the two panels together at the tongue and groove joint.

French Application No. 2 697 275 discloses the formation of a surface from rectangular shaped slabs placed on a flat horizontal surface. The application discloses that the body of the slab has shaped sections on all four sides and that the slabs can be mechanically joined together via a number of ribs running lengthwise along the slab which are shaped so that they slide into a matching groove in the adjacent slab. FIG. 2 appears to disclose a member 33 for connecting two adjacent slabs. As shown, the top surface of the member 33 forms a portion of the top wear surface of the resulting floor. This also can be seen in FIG. 1 where members 5 and 6 form a portion of the top wear surface.

Japanese Application No. 54-65528 shows in FIGS. 1–3 a particular tongue and groove arrangement for interconnecting two adjacent panels.

French Application 2 568 295 discloses a prefabricated flooring system consisting of a series of flat panels which are laid directly on the ground. The panels are made, for example, from a resin compound either containing reinforcing elements or incorporating granules of a durable material such as quartz or carborumdum. The patent discloses that the panels have interlocking joints on all their edges, made in the form of projections and recesses, and the under surface of each panel can be covered with a layer of non-decomposing cellular and flexible material which is able to compensate for irregularities in the surface of the ground.

UK Patent Application No. 424,057 discloses a method of constructing a parquet floor which comprises the use of reversible rectangular blocks each having protruding flanges forming sphenoidal grooves on each of its four sides, each groove extending across the whole of the side in which it is situated. The patent teaches the grooves on two co-terminus sides having their mouths facing upwards when the mouths of the other two grooves on the other two sides face downwards, whereby a plurality of such blocks may be built up into a floor covering in which each block is locked on each side which lays contiguous with the side of another such block. The method is stated to also comprise the use of connecting members having flanges adopted to engage beneath the overhanging flanges of two adjacent blocks where a change in direction of laying is required.

UK Patent No. 1,237,744 titled "Improved Building Structure," discloses that it relates to a building structure composed of panels joined at their edges by first tongue and groove connections having elements located in the plane of the building structure as well as by second tongue and groove connections having elements located perpendicular to said plane.

UK Patent No. 1,430,423 titled "Joint Structure," discloses in FIGS. 1 and 2 a specific tongue and groove/notch and tooth joint structure for interconnecting plastic and metal materials.

UK Patent Application No. 2 117 813A titled "Pivotal Assembly for Simulated Wall Panels," discloses a joint assembly comprising a pair of strips secured to the edges of the respective panels by folding the outer skins of the panels and by a dovetail joint in the foam insulation material inside the panels. The application discloses the connecting strips provide a curved tongue and groove. The groove strip has a pivotal body of part-cylindrical shape so that one strip can be pivoted relative to the other for a tongue to enter the groove. The application discloses that a locking strip is provided to be inserted into a groove to lock the panels together.

UK Patent Application No. 2 256 023A titled "Joint," discloses a joint between the joining side edges of two similar panels in which one panel has a channel-section recess open towards the front face and the other panel has a rib facing towards the rear face for reception in the recess to restrict separation of the panels to provide a predetermined expansion gap between the adjacent side edges. The application discloses that the panels may be tongue and groove boards for construction of, for example, a door. The application discloses in the figures a particular tongue and groove/notch and tooth joint.

Utlengningsskrift No. 157871 discloses in the figures the connection of two adjoining members utilizing a tongue and groove joint at the edges and which includes recesses formed in said panels spaced from the joint for receipt of a U-shaped member for holding the two panels together at the tongue/groove joint.

Utlaggningsskrift No. 7114900-9 discloses in FIGS. 1–3 means for connecting two adjacent members utilizing connection blocks 2, 5 and 9 wherein said blocks form a part of the top wear surface. The application further discloses a U-shaped member for insertion on the backside of the panels to hold the two panels together at the joint where the joint block exists.

WO 84/02155 titled "Device for Joining Together Building Boards, Such as Floor Boards," discloses a device for joining together building boards, such as floor boards, edge surface to edge surface. The application discloses a system wherein the boards comprise a groove in the rear side of each board, the groove running over the entire length of the board parallel to its joining edge, and a substantially U-shaped spring device, the legs of which are each adapted to engage the groove of one board, and which is prestressed so that, upon engagement, the boards are tightly clamped together edge surface to edge surface.

Patentschrift 200949 discloses in FIGS. 1–6 panels for joinder one to another wherein the panels include on two intersecting edges extending tongue strips and on the other intersecting edges an extending groove strip.

WO 93/13280 titled "A Device for Joining Floor Boards," discloses a device for joining floor boards comprising elongated, flat-shaped body with legs adapted to engage a longitudinal groove in each of the joining floor boards. The legs are shaped at a distance from the ends of the plate-shaped body in such a manner that the plate-shaped body supports the boards on each side of the grooves.

U.S. Pat. No. 3,538,665 titled "Parquet Flooring," discloses a floating parquet flooring comprising rectangular-shaped two-layer flooring units composed of a parquet layer and a backing layer. The bottom face of the backing layer being provided with marginal recesses along the four sides of the unit and a strip of backing layer material being inserted in the space formed by such marginal recesses for bridging the joint between adjacent units. The patent discloses that the backing layer material has a modulus of elasticity in tension not exceeding 5000 kg/cm$^2$.

Offenlegungsscrift 26 16 077 A discloses a connection web with a flange for connecting plates resting flat on a supporting substrate. The patent application discloses the arrangement is especially useful for connecting prefabricated parquet floor elements. The application discloses that a pliable connection arrangement is provided which replaces rigid connectors such as adhesives or nails. The application states that the system is advantageous because it accommodates expansion and shrinking stresses which thus, prevents cracking. It is stated that the connecting web prevents overlapping of the plate edges on uneven substrates and in use the connection web is loaded in tension when the plates expand. On contraction of the plates, the connection web pulls the plates together and prevents gap formation.

French Application No. 1 293 043 discloses in FIGS. 1–3 a tile having four edges wherein one set of intersecting edges includes a tongue extending therefrom and the other two intersecting edges includes a groove open in the direction of the bottom side of the tile. FIGS. 4–6 disclose tiles having four edges wherein two intersecting edges include a notch and a groove open toward the top side of the panel and the other two intersecting edges have a notch and a groove open toward the bottom of the panel.

Utlaggningsskrift No. 8206934-5 discloses the joining of two panels wherein a tongue and groove arrangement is utilized. The drawings further disclose a U-shaped clip for insertion into the panels on either side of the joint for holding the two panels together at said joint.

WO 97/47834 titled "Floor Covering, Consisting of Hard Floor Panels and Methods for Manufacturing Such Floor Panels," discloses a floor covering consisting of hard floor panels which, at least at the edges of two opposite sides, are provided with coupling parts cooperating with each other. The coupling parts are substantially in the form of tongues and grooves characterized in that the parts are provided with integrated mechanical locking means. The locking means prevent the drifting apart of two coupled floor panels into a direction perpendicular to the related edges and parallel to the underside of the coupled floor panels.

There still exists a need for a system, including methods and components, which provides an efficient and easy means for the assembly and disassembly of thin floating decorative laminate floor surfaces wherein a level uniform seam is formed between adjacent panels and the visible flooring surface consists of only the decorative surface.

SUMMARY OF THE INVENTION

According to one embodiment, the present invention comprises a disengageable interconnecting floor system for use in forming temporary or permanent flooring surfaces on top of a support structure from individual flooring panels. The system preferably comprises two or more flooring panels comprising a top wear surface and a bottom surface for contact with the support structure. The panels, according to this embodiment, comprise at least three edges wherein all of the edges have identical grooves or recesses formed therein for receipt of a projection from a connector. Preferably, the grooves or recesses extend substantially the entire length of the panel edges. The preferred connector comprises a base and a projection extending vertically from the base, spaced from the base and substantially parallel thereto. The projection is shaped to be received in a disengageable vertical connected fashion into at least one recess of at least one panel.

According to a preferred embodiment, the preferred connector of the system of the present invention further includes a projection that is shaped to be received in a disengageable horizontal connected fashion into at least one groove or recess of the panels.

According to another embodiment of the present invention, the base of the novel connecting element has grooves or other recesses formed therein, and at least one panel edge is shaped to be received in a disengageable horizontal connected fashion into the groove or recess of the base of the connecting element. The groove or recess may be formed in the base or in part of the above-described projection.

According to yet another embodiment of the present invention, a projection of the connector according to the present invention has a groove or other recess formed therein, and at least one panel is shaped to be received in a disengageable horizontal connected fashion in the groove or other recess of the projection.

According to a further embodiment of the present invention, the distance from the base of the connector to the top or uppermost point of the projection, preferably tongue-shaped, of the connector is less than the distance from the bottom surface to the top wear surface of the panels.

According to another embodiment of the present invention, a disengageable interconnecting flooring system is provided for use in forming temporary or permanent flooring surfaces on top of a support structure from individual flooring panels. The system comprises two or more flooring panels, preferably laminated, and at least one elongated connector, e.g., a track. The flooring panels preferably have a top wear surface, a middle reinforcing substrate material, and a bottom surface for contact with a support floor structure. The panels have four edges with identical grooves formed therein, preferably in all edges, for receipt of a vertically extending projection of the track. The panels also have notches or other recesses, e.g. channels, formed in their bottom surfaces shaped for receipt of nodes or other protrusions from the connector. Preferably, the grooves and the channels extend substantially the entire length of the edges of the panels.

The connector, according to one embodiment of the present invention, has a base with preferably a single projection extending vertically therefrom shaped to be received in a disengageable vertical connected fashion into grooves or other recesses in the edges of the panels. Preferably, the connector is substantially, if not the same, length as the panel edges to be connected. Preferably, the projection extends the entire length of the connector. The base of the connector further has two nodes or two other protrusions extending vertically from either side of the base spaced from the single projection. The protrusions are shaped to be received in a disengageable horizontal connected fashion into the notches or other recesses, e.g., channels, in the bottom surface of the panels. Preferably, the protrusions extend substantially the entire length of the edges of the panels. When the panels are connected using the connector, the resultant visible flooring surface consists of only the top wear surface of the panels.

According to another embodiment of the present invention, a vertical and horizontal interconnecting flooring system for use in forming a flooring surface on top of a support surface is provided. The system comprises two or more individual flooring panels, preferably laminated floor panels, having a thickness, and at least one connecting track. The flooring panels have a top wear surface and a bottom surface for contact with a support surface. The panels have at least three edges wherein all edges have first identical recesses formed therein. The first recesses are shaped to receive a first connection projection from the track. The panels also have second recesses, e.g., channels, located along the bottom surfaces of the panels open in the direction of the ground or support surface for receipt of a second connection projection from the track. The track, according to this embodiment, has a base, a first connection projection, and a second connection projection. The first connection projection is connected to and extends vertically a distance from the base and is shaped to be received in the first recesses of the panels to form a vertical connection between the panels. The second connection projection connected to and extending vertically a distance from the base, preferably a distance less than the first projection, and shaped to be received in the second recesses of the panels to form a horizontal connection between the panels. According to this embodiment, the distance from the base of the track to an uppermost vertical portion of the first projection is less than the distance between the top wear surface and the bottom surface of the panel in contact with the support surface such that when two panels are connected, said first and second connections form a flooring surface consisting of only the top wear surface of the panels.

According to a further embodiment of the present invention, a disengageable decorative laminate flooring system for application to an existing floor surface without the use of adhesives or traditional fastening devices is provided. The system comprises a plurality of identical individual floor panels and connectors. The individual floor panels have a top decorative wear surface and comprise at least three edges each having an identical receiver located in said edges, i.e., each edge of each panel comprises the same configuration. The connectors, preferably comprise rails, of substantially the same length as the edges of the panels. The rails have extending vertically therefrom a first projection and a second pair of projections. The first projection being shaped for insertion into the receivers for disengageable vertical interconnection of the individual flooring panels at their edges. The second pair of projections being shaped for insertion into the receivers for disengageable horizontal interconnection of the individual flooring panels at their edges. Preferably, the first projection and second pair of projections extend substantially the entire length of the rail. And when the panels are interconnected using the connectors, according to this embodiment, the visible resultant flooring surface only consists of the top decorative wear surface, i.e., no portion of the connector forms a part of the visible flooring surface.

According to one embodiment, the present invention is directed to a disengageable connector for vertically and horizontally interconnecting individual flooring panels to form a laminate flooring surface on top of a support structure. The connector preferably comprises a base for contact with the support structure. The base, according to one embodiment, has a projection extending vertically therefrom in a direction away from the support structure. The projection has top and bottom portions consisting of identical right and left halves, each half preferably comprising a tongue-like extension extending a distance substantially parallel to and spaced above said base. Optionally, according to a particularly preferred embodiment, the base includes two additional protrusions extending vertically therefrom. These protrusions are spaced apart and located on either side of said projection.

According to yet another embodiment, the present invention is directed to individual flooring panels for use in forming a flooring surface on a support structure, said flooring surface comprised of said panels disengageably interconnected horizontally and vertically. The panels, according to this embodiment, comprise a top surface, a bottom surface, and edges between the top and bottom surfaces. The top surface comprises a decorative wear surface. The edges comprise identical grooves and/or recesses extending substantially the entire length of the edges. The bottom surface comprises identical channels formed therein and open toward the support structure or away from the top surface. These channels are parallel to, spaced from, and preferably extend substantially the entire length of the edges.

The present invention is directed to a unique and novel system for easily joining and disjoining a flooring surface, preferably a thin (less than an inch thick) laminate flooring surface of the "floating" type. The system is designed such that additional traditional fastening means are not needed, e.g., nails, screws, adhesives, tacks, staples, etc. are unnecessary. The present inventive system accomplishes this task without the need of special tools or floor laying experience. The present inventive system accomplishes its advantages utilizing preferably identical joining panels with preferably identical novel edges making assembly easy and flexible, even for the novice. Moreover, the present inventive system provides a single connecting means for use in relation to all edges of the novel panels—again, making assembly and disassembly easy. More importantly, due to the fact that at least two edges of the panels have recesses formed therein during manufacture, either less reinforcing substrate material is needed to manufacture the panels and thus, saving resources and/or less decorative top surface material is wasted, ie., it is not necessary to remove as much of the top wear surface portions to provide for the interconnecting system of the invention.

DETAILED DESCRIPTION OF THE INVENTION

Figure 1:
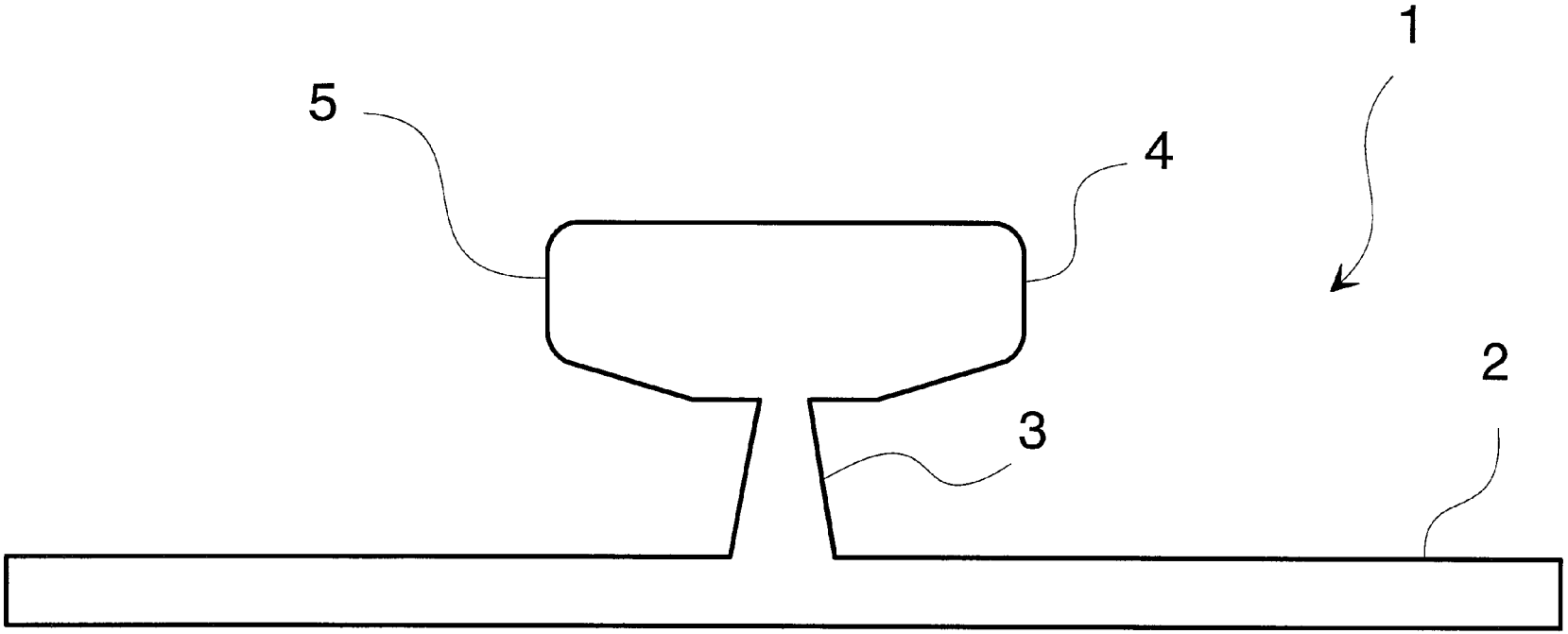
FIG. 1 illustrates one embodiment of the connector of the present invention.
Figure 2:
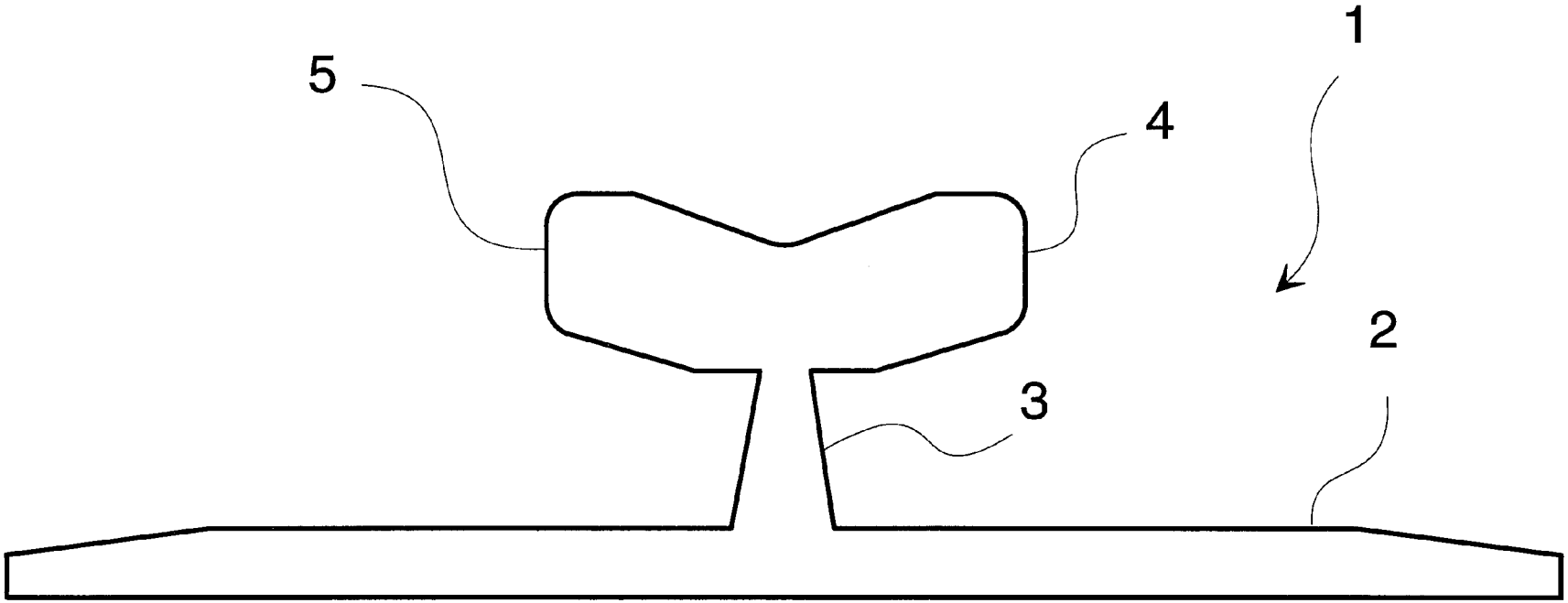
FIG. 2 illustrates one embodiment of the connector of the present invention.
Figure 3:
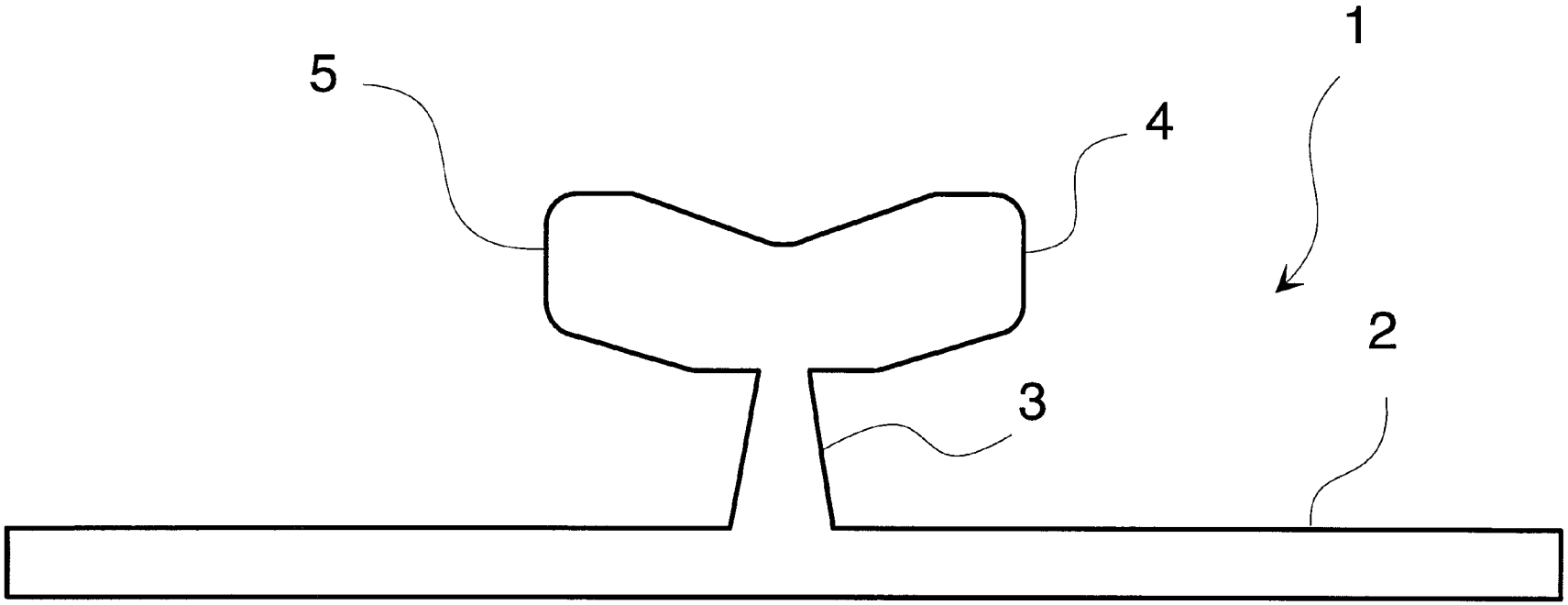
FIG. 3 illustrates one embodiment of the connector of the present invention.
Figure 4:
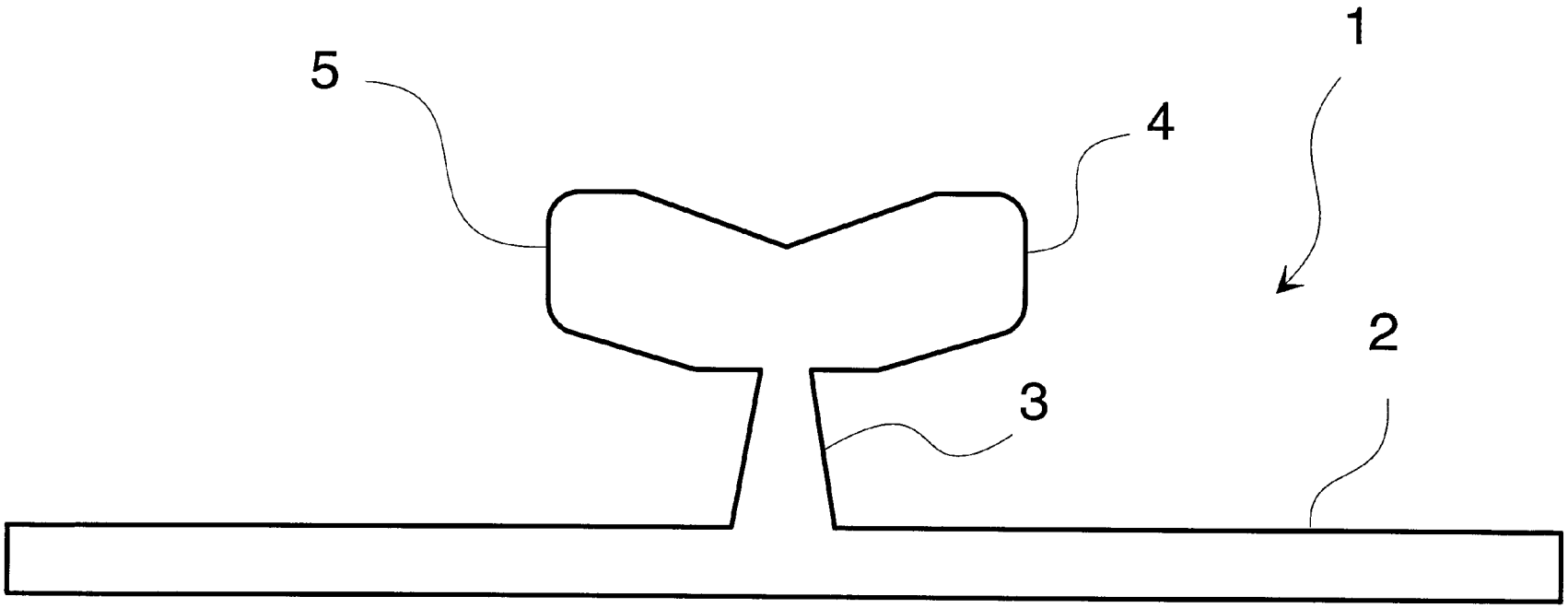
FIG. 4 illustrates one embodiment of the connector of the present invention.
Figure 5:
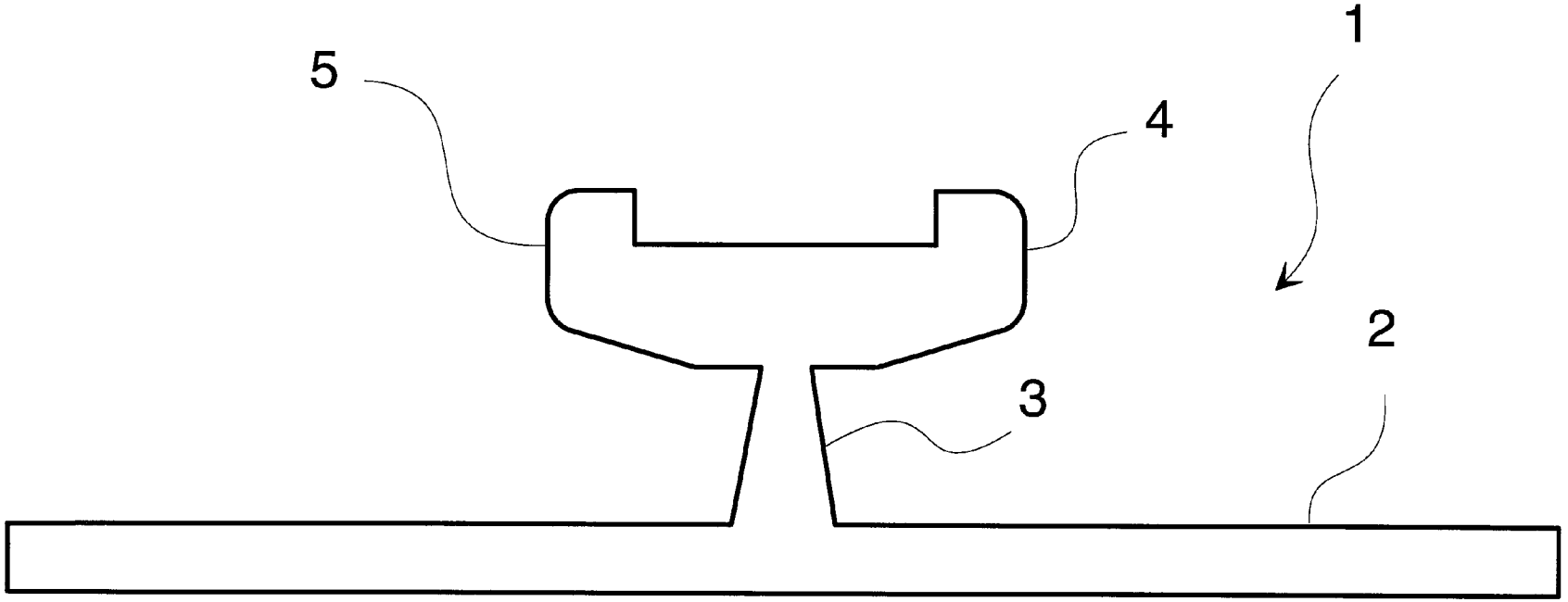
FIG. 5 illustrates one embodiment of the connector of the present invention.

In a preferred embodiment, the present inventive system is directed to decorative laminate flooring panels, squares, tiles, rectangles, etc. each having a top wear surface, a middle substrate or reinforcing material below the top surface, and optionally, a backing layer surface attached to the middle substrate material for contact with the supporting or existing floor or ground surface.

The top wear surface of the panels of the present invention, preferably comprises decorative laminates or laminates prepared by heat and pressure consolidation. These panels have been produced commercially for a number of years, and have found widespread acceptance in the building and furniture industry as counter and table tops, bathroom and kitchen work surfaces, wall paneling, partitions and doors. Such decorative laminates can be described as containing a number of laminae that are consolidated to form a composite or unitary structure carrying a surface decoration which can range from something as simple as a solid color to something as complex as an embossed simulated wood grain finish.

More specifically, a decorative laminate, useful in the present invention, generally comprises a plurality of layers of synthetic resin impregnated paper sheets consolidated or bonded together into a unitary structure under heat and pressure. In normal practice, the decorative laminate assembly, from the bottom up, consists of a core of one or more sheets impregnated with phenolic resin, above which lies a decorative sheet impregnated with melamine resin and/or an overlay impregnated with melamine resin. The core or base member functions to impart rigidity to the laminate and usually comprises a solid substrate which may or may not be formed prior to the initial laminating step. Prior to stacking, the sheets of the core member are impregnated with a water alcohol solution of phenol and formaldehyde or a formaldehyde precursor, dried and partially cured in a hot air oven, and finally cut into sheets. Examples of such a base or core member include: (1) a plurality of sheets of 90 to 150 pound ream kraft paper impregnated throughout and bonded with a substantially completely cured phenolic resin which has been converted to the thermoset state during the initial laminating step; (2) a precured plastic laminate such as glass fiber-reinforced thermoset polyester resin laminates or the like; (3) a wood product such as hardboard, fiberboard, woodwaste, particle boards, plywood or the like; (4) a mineral base board such as cement-asbestos board, sheet rock, plaster board or the like; (5) plastic impregnated boards; (6) plastic/wood compositions; (7) plastic compositions; (8) closed-cell polyurethane foam, e.g., RIM foam; (9) urethane impregnated boards; (10) a combination of these substrates; or (11) any material suitable to perform the desired function of the base or core member.

The decorative sheet, useful in the panels of the present invention, generally functions to give an attractive appearance to the laminate, and also gives the panel its surface characteristics (i.e., resistance to chemical agents, to heat, to light, to shock and to abrasion). The decorative sheet typically is a high quality 50 to 125 ream weight, pigment filled, alpha cellulose paper that has been impregnated with a water-alcohol solution of melamine-formaldehyde resin, dried and partially cured, and finally cut into sheets. The decorative sheet may be of a solid color or may comprise a decorative design or pattern, or a photo reproduction of natural materials, such as, wood, marble, leather, etc. As stated above, the decorative sheet and/or an overlay sheet may be impregnated with melamine resin.

The decorative laminate useful in the manufacture of the panels of the present invention, is generally obtained by, but not limited to, placing the resin impregnated core and decorative sheets between steel coated, steel, or stainless steel plates and subjecting the laminate stack to temperatures ranging from about 150° F. to about 500° F. and pressures ranging from about 800 to about 1600 psi for a time sufficient to consolidate the laminate and cure the resins (generally about 25 minutes to an hour). This causes the resin in the paper sheets to flow, cure, and consolidate the sheets into a composite or unitary laminated mass referred to in the art as a high pressure decorative laminate (IPDL). More than one laminate can be formed at one time by inserting a plurality of assembled sheets in a stack with each assembly being separated by a release sheet which allows the individual laminates to be separated after consolidation. Finally, the decorative laminates are further processed and are generally bonded to a reinforcing substrate, such as medium to high density fiber board, wood/plastic compositions, woods, plywood, hardboard, asbestos board, particleboard, ceramics, filled and unfilled plastics, closed-cell rigid foams, or the like. If a cushioning effect is desired, the reinforcing substrate may be comprised of open-cell foam.

The decorative laminate useful in the practice of the present invention may also be obtained by placing the resin impregnated core and decorative sheets between steel coated, steel, or stainless steel plates and subjecting the laminate stack to temperatures ranging between about 150 F. to about 500° F. and pressures ranging below about 800 to about 1600 psi for a sufficient time to consolidate the laminate and cure the resins. This causes the resin in the paper sheets to flow, cure, and consolidate the sheets into a composite or unitary laminated mass known in the art as a low pressure decorative laminate (LPDL).

In addition, according to one embodiment, the reinforcing substrate of the present invention may be prepared from any suitable extrudable thermoplastic, so long as it has the structural and mechanical properties necessary for the end use desired. In particular, it is preferred that the substrate have a compression set that is approximately the same or better than conventional medium or high density fiberboard or particle board (wherein compression set is measured in accordance with ASTM F970, as thickness decreases as a function of compressive stress). Preferably, this thickness decrease at 2000 psi is at most 0.01 inch, more preferably at most 0.005 inch, and most preferably at most 0.001 inch.

Preferably, the reinforcing substrate useful in the practice of the present invention comprises one or more members selected from the group consisting of rigid urethanes (e.g., RIM foam), poly(acrylonitrile/butadiene/styrene) (hereafter referred to as ABS) resins such as flame retardant ABS resins and glass filled ABS resins; polycarbonate; high impact polystyrene (HIPS), polystyrene, polyphenylene oxide (PPO), and polyvinyl chloride (PVC). Preferably, the reinforcing substrate is prepared from a commingled resin system containing, but not limited to, one or more of the above listed polymers. Further, these polymers can be filled or unfilled, although from an impact resistance and physical property standpoint, the filled polymers are best. Preferred fillers include calcium carbonate, talc, silica, glass fibers, alumina and wollastonite, with the more preferred being calcium carbonate and wollastonite, and the most preferred being calcium carbonate. Non-limiting examples of reinforcing agents include inorganic or organic products of high molecular weight, including glass microspheres, glass fibers, asbestos, boron fibers, carbon and graphite fibers, whiskers, quartz and silica fibers, alumina fibers, fused fiber materials and organic fibers. When such conventional ingredients are utilized, they will generally be present in a range from about 0.01 to about 50 weight percent of the total weight of the reinforcing substrate member, preferably in a range from about 1 to about 25 weight percent of the total weight of the member.

Additional optional layers may be inserted between the core member and the decorative surface member, on the back of the reinforcing substrate member, or on the decorative surface member. It should be understood that backing layers and/or decorative layers may be coextruded with the reinforcing substrate member, or may be applied after the extrusion step by any suitable method.

The panels, according to one embodiment of the present invention, are preferably water repellant and most preferably substantially waterproof. As with conventional flooring panels, the present panels include a decorative layer, a substrate, and a backing layer. The decorative layer and the backing layer are respectively bound to the substrate in a conventional manner to form the present panel. In accordance with a preferred embodiment of the present invention wherein the reinforcing substrate material is fiberboard, the backing layer includes, from bottom up, a hydrophobic waterproof layer and three layers of phenol formaldehyde resin impregnated kraft paper. As with the bottom resin impregnated layer of the decorative layer, the top resin impregnated layer of the backing layer is sanded for bonding with the substrate. The hydrophobic waterproof layer may be a DYLARK-like compound. DYLARK is a styrene-maleic anhydride copolymer manufactured by NOVA Chemicals, Inc. DYLARK exhibits outstanding bonding characteristics with the phenolic resin impregnated kraft paper. The excellent bonding characteristics are thought to be a result of the carboxyl groups found on the maleic anhydride of the DYLARK copolymer. The carboxyl groups bind with the phenolic resin to produce a very stable laminate. Although DYLARK is disclosed as the preferred material for the bottom layer of the backing, other functionally and structurally equivalent polymers may be used without departing from the spirit of the present invention. It is not only desirable to prevent moisture from penetrating the backing layer but also to maintain the original as-manufactured moisture content of the panel to prevent panel warpage.

In addition, although phenol formaldehyde resin impregnated kraft paper is used in accordance with a preferred embodiment of the present invention, other resin impregnated papers (or similar materials) may be used without departing from the spirit of the present invention. The resin impregnated layers are maintained in the present backing layer to balance the resin impregnated layers commonly found in decorative layers which may be used in conjunction with the backing layer. That is, the resin impregnated layers in the decorative layer and the backing layer similarly expand and contract as a result of temperature to maintain the substantially flat configuration of the flooring panel. If the resin impregnated layers in the backing layer were not included, the decorative panel would expand and contract at a different rate than the backing layer. This would cause the flooring panel to warp in an undesirable manner. As such, it should be appreciated by those of ordinary skill in the art that the phenolic layers may be varied to maintain a balanced relation between the backing and the decorative layers.

As stated, the substrate is preferably poly(acrylonitrile-c-butadiene-c-styrene) (ABS) foam. The construction of the backing layer and the substrate results in a waterproof flooring panel which is not susceptible to the harmful environmental conditions commonly found in certain environments. Specifically, the ABS substrate and styrenemaleic anhydride copolymer layer create a moisture barrier which protects the resin impregnated layers from the undesirable effects of moisture.

The above-described flooring panels are manufactured utilizing techniques known in the art. During manufacturing, panels may be machined to form the appropriate recesses in the edges or preferably, may be manufactured wherein at least two edges have recesses formed therein during manufacture of the panel and thus, reduce the amount of material needed to manufacture the panel. In addition, the panel of the present invention, according to one embodiment, may be manufactured utilizing injection molding techniques wherein all edges are formed.

The connector of the present invention includes a number of embodiments. A few of the embodiments are graphically set forth in FIGS. 1–18. Referring now to FIGS. 1–18, wherein the same numerals are used to identify the components of a connector of the present invention, as follows: "2" identifies the base of connector 1, "3" identifies a support extending vertically from base 2, "4" identifies a part of a projection extending vertically from base 2 via support 3, "5" identifies another part of a projection extending vertically from base 2 via support 3, "6" identifies a protrusion extending vertically from base 2 of connector 1, "7" identifies another protrusion extending from base 2 of connector 1, "8" identifies a recess in one side of base 2 of connector 1, "9" identifies a recess on another side of base 2 of connector 1, "10" and "11" identify second projections extending from parts 4 and 5 of the first projection which are extending vertically from base 2 via support 3, "12" identifies a recess in between second projections 10 and 11, and "13" and "14" identify recesses located underneath the top portion of the projection (collectively 3, 4, and 5). Preferably, the system of the present invention comprises a connector having the projection (collectively 3, 4, and 5) and protrusions 6 and 7, and the panels have recesses and channels such that two panels can be disengageably interconnected using the connector in a horizontal and vertical fashion without the use of glue or other adhesives.

It is to be understood that FIGS. 1–18 are not meant to limit the scope of the invention but are provided to give example embodiments, including the preferred embodiment, of various components of the novel connector of the present invention. Indeed, various combinations of different embodiments of various individual components of the connector can be utilized, i.e., various base 2 configurations illustrated in, e.g., but not limited to, FIGS. 1, 2, 7, 8, 9, 10, 11, 12, etc. can be utilized with various embodiments of the projection, e.g., but not limited to FIGS. 1, 2, 3, 5, 6, 16, 17, 18, etc., even though the exact combination configuration may not be graphically shown in the figures. Preferably, the connector is less than 0.240 inches in height.

The connector of the present invention may be manufactured from materials selected from the group consisting of filled and unfilled plastics, rubbers, wood compositions, ceramics, metals, and combinations thereof Preferably, in use with the preferred laminate flooring panels, the connector of the present invention is manufactured from metal or plastic. Depending upon the material and size, the connector may be manufactured using techniques known in the art e.g, the connector is preferably manufactured from aluminum.

The panels of the present invention include recesses formed therein shaped to receive a connector such that when the panels are connected, the top visible flooring surface only consists of the top wear surface, ie., preferably, a decorative layer. The connector projections and panel recesses are formed such that when two panels are joined together using a connector of the present invention the panels are vertically connected together, ie., if two panels are connected at their edges, the edges of the opposing panels do not move up or down (vertically) relative to each other and thus, provide a level uniform seam between the two. For example, in a preferred embodiment, once connected the panels are engaged against movement relative to each other in the direction of a plane extending vertically from the support surface and perpendicular thereto.

In a particularly preferred embodiment, in addition to vertical connection, the panels and connectors are so shaped to provide a horizontal connection between adjacent panels at their edges, ie., if two panels are connected at their edges, the edges cannot move any from each other horizontally resulting in a gap between adjacent panels. For example, and according to one embodiment, once connected, the panels are engaged against movement relative to each other in a direction horizontal to the support surface and parallel thereto.

Various non-limiting embodiments of the connector of the present invention have been described and while not shown, the panels of the present invention are necessarily configured, for example, to correspond to these connectors to achieve the advantages of the present invention. It being understood that the panels can be configured to provide an exact fit with the connectors or a non-exact fit, as long as the advantages of the present invention are achieved. For example, where a permanent structure is desired, an embodiment allowing space for glue to accumulate between the panels and the connectors may be appropriate. In addition, when utilizing certain reinforcing substrate materials it might be undesirable for the panels and connectors to fit together exactly, especially when a temporary structure is desired. For example, some space between certain portions of the connector projections and the recesses of the panels can be tolerated as long as the advantages of the invention are achieved, especially a resultant floor having only the top wear surface visible with level uniform seams.

The panels are constructed such that they disengageably interconnect with the connectors of the present invention, ie., while the connectors and panels are securely connected to perform the function of a flooring surface, the panels can, if desired, be removed by lifting a panel and pulling the panel away from the connector—disengaging the panel/connector interconnection.

The panels of the present invention, according to one embodiment, are constructed such that when connected together utilizing a connector of the present invention, they always form a tight uniform level seam between the panels. The panels, according to a preferred embodiment, are constructed such that the depth of the recess or channel in the bottom surface of each panel is always a certain distance from the top wear surface. As stated above, these recesses or channels are shaped to receive a protrusion projecting from the base of a connector (preferably a track) to disengageably interconnect two panels together horizontally. Thus, at the interconnection point, both panels rest on the connector. Consequently, even when the support structure or ground floor is uneven or not level, the seam is always tight, uniform and level. Thus, even if the thickness of the panels vary, a uniform level seam is provided when two panels are interconnected because the depth of the recesses or channels in the bottom surface of each panel is formed to be a certain distance from the top wear surface. Therefore, the top wear surfaces of two adjacent panels will always come to rest at the same level, i.e., a certain distance from the base protrusions of the connector. Preferably, the panels of the present inventive system, range in thickness from about 0.240 inches to about 0.320 inches. According to another embodiment, the panels are less than an inch thick. The system of the present invention also provides panels which utilize substantially all of the manufactured laminate top wear surface and thus, provides an economic advantage over many prior art systems. In prior art systems, a panel is manufactured having a top wear surface. After manufacture, the panel is machined at the edges to remove a portion of the top wear surface to form a tongue extension for insertion into a corresponding groove of an adjacent panel. To form the tongue, the top wear surface has to be machined off thus, decreasing the amount of marketable square feet of flooring per panel. In addition, the removal of more top wear surface accelerates tool wear and thus, tools require more maintenance, and/or replacement. Consequently, the cost and time of manufacture increases. Utilizing the system of the present invention, the amount of top wear surface of the panels that needs to be machined to remove any part of the already manufactured and paid for decorative top wear surface is greatly reduced. Substantially all of the manufactured decorative top wear surface is sold to the end user—eliminating waste experienced in prior art systems. As a result, the total square footage of saleable flooring produced by a plant is increased and costs are reduced.

In addition, the connectors of the present invention are not fixed to the panels at the factory and thus, no adhesive or other fastening means is required to be applied—again, reducing material costs, labor costs, and time to manufacture. In a preferred embodiment, the panels are manufactured having all of the necessary recesses formed therein utilizing injection molding techniques. In another preferred embodiment, wherein the middle reinforcing substrate of the panel is extruded, only two edges have to be machined to form recesses therein—the other two edges running in machine direction are formed during extrusion. Both of the above provide additional savings due to the fact that the amount of middle reinforcing substrate material used is reduced, ie., never produced. In prior art systems, the reinforcing substrate material is manufactured and then, a portion is machined away to form a groove.

The system of the present invention also provides panels which are less susceptible to damage than prior art tongue and groove systems. For example, it is known that the tongues of panels are susceptible to damage during shipping, handling, and even assembly and disassembly. If a tongue is broken off or substantially deformed, it will not be able to engage the groove of an adjacent panel and therefore, is rendered useless. The panels of the present invention do not include tongues—they only have recesses or grooves formed therein. It is difficult, if not impossible, to damage a recess or groove during shipping, handling, assembly and disassembly. Thus, the panels of the present invention are more durable than many prior art panels. This is a significant advantage in relation to the use of the panels for "floating floor" surfaces and temporary flooring constructions which will be removed and reassembled many times. The system of the present invention provides connectors (preferably made from metal) which are fairly tough, and easy and economical to replace, when compared to the cost of a new panel. The present inventive systems substantially reduce, if not eliminate, the risk of damaging a panel to the extent that it is inoperable.

The flooring system of the present invention provides a flooring surface which is easy to repair and/or change. For example, many prior art systems, for example, the systems in U.S. Pat. Nos. 5,706,621 and 5,860,266 require holding the new panel to be joined at an angle relative to a principal plane of a first laid panel and angling down the new panel to become mechanically locked underneath a portion of the first panel. This is repeated until a floor is constructed. If the fifth panel in a sequence of 20 panels needs to be replaced, e.g. due to damage, panels 6 through 20 have to be removed in reverse order to reach panel 5. Utilizing the system of the present invention, which does not require the angling down of each new panel underneath a portion of an existing panel, panels 1 to 4 of the sequence can be removed and panel 5 replaced. Thus, the present inventive system substantially reduces the time and aggravation of removing and replacing panels. In addition, due to the fact that the panels of the present inventive system do not require a single directional laying sequence, more than one person can construct different portions of a single flooring surface simultaneously for interconnection later. This is especially advantageous in relation to the installation of large flooring surfaces, e.g., retail spaces.

The panels of the present inventive system also provide substantially more aesthetic flexibility than prior art panels. For example, since the panels are not right or left handed, i.e., one or unidirectional, but instead are multidirectional due to each edge being identical, each individual panel can be placed into a flooring surface being constructed in the most eye-appealing manner. Moreover, the panels of the present inventive systems allow for flexibility in designing and constructing parquet-type flooring surfaces. For example, it is known that a panel is usually manufactured wherein the grain runs in the machine direction; however, since the panels of the present invention are multidirectional, the direction of the grain on the flooring surface can be easily alternated to form a parquet floor, or a floor of any grain design.

The panels of the present inventive system also reduce waste during floor construction. Typically, when constructing a flooring surface using prior art systems with handed panels, the construction starts at one wall and proceeds across the space to the other wall. And, normally, a space to be floored is not of a dimension which is equally divisible by the size of a flooring panel, ie., panels at an end wall have to be cut length or width wise to fit. In prior art systems utilizing handed panels, once a panel is cut there is a substantial possibility that the remaining portion is unusable. For example, in a prior art system utilizing rectangular panels with tongues and grooves on opposing intersecting edges respectively, when a panel is cut lengthwise two panel pieces are formed with one long edge of each either being a tongue or a groove. At the end wall, a portion of a panel may be needed with a groove on the long edge and it is inserted. As a result, only a panel piece having a tongue on the long edge remains without a long groove edge. However, with the panels of the present invention, ie., each panel is constructed with grooves on all edges, any panel portion remaining after completing the floor up to a portion of the end wall is also possibly useable to complete another portion of the floor up to the end wall.

The panels of the present inventive system are constructed such that to assemble two panels together it is not necessary to hold one panel at an angle relative to the other panel and angle down the new panel into place. The fact that the panels can be interconnected by forcing two together while they are lying in the same plane is very advantageous in relation to constructing certain portions of flooring surfaces challenged by various physical boundaries, e.g., the interface between a flooring surface and a fireplace.

Figure 6:
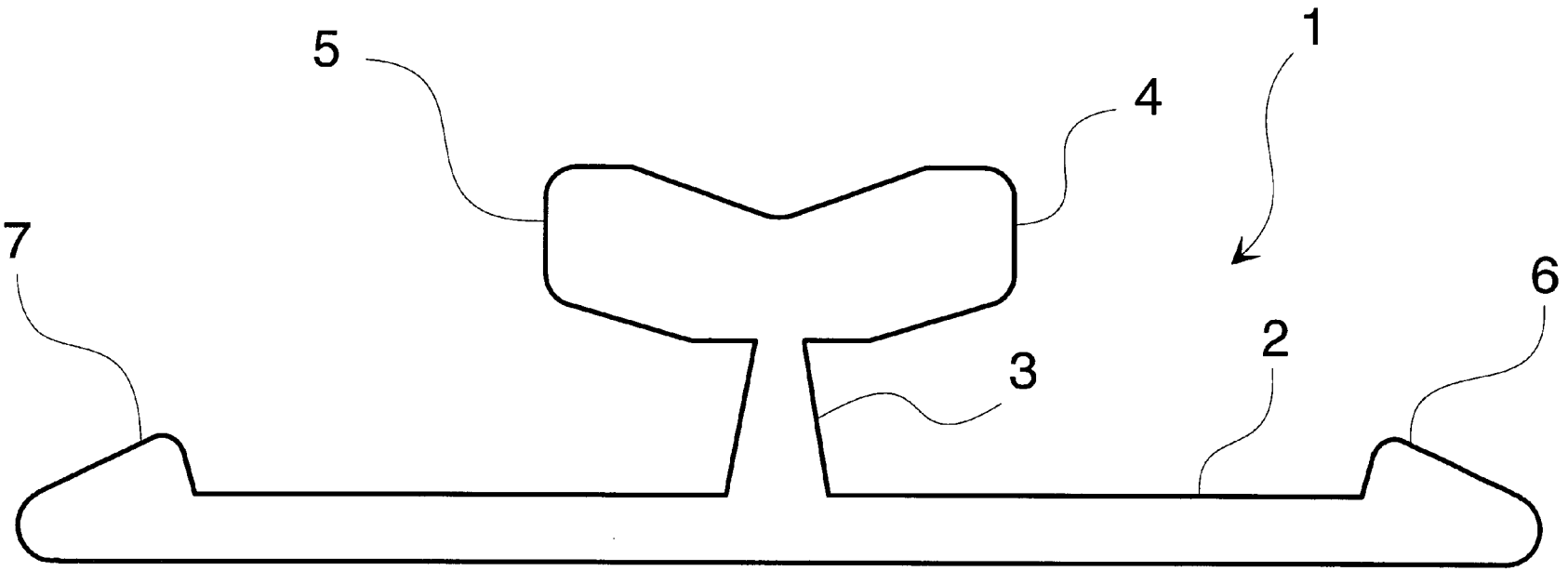
FIG. 6 illustrates a preferred embodiment of the connector of the present invention.
Figure 7:
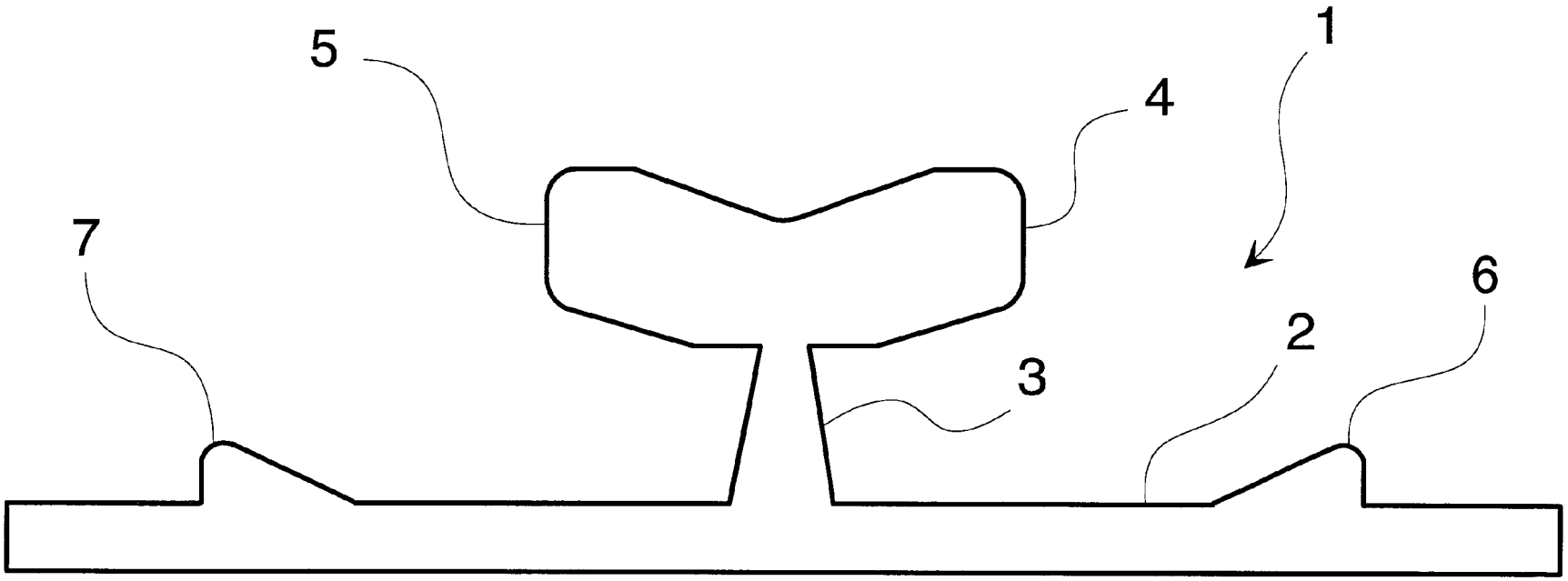
FIG. 7 illustrates one embodiment of the connector of the present invention.
Figure 8:
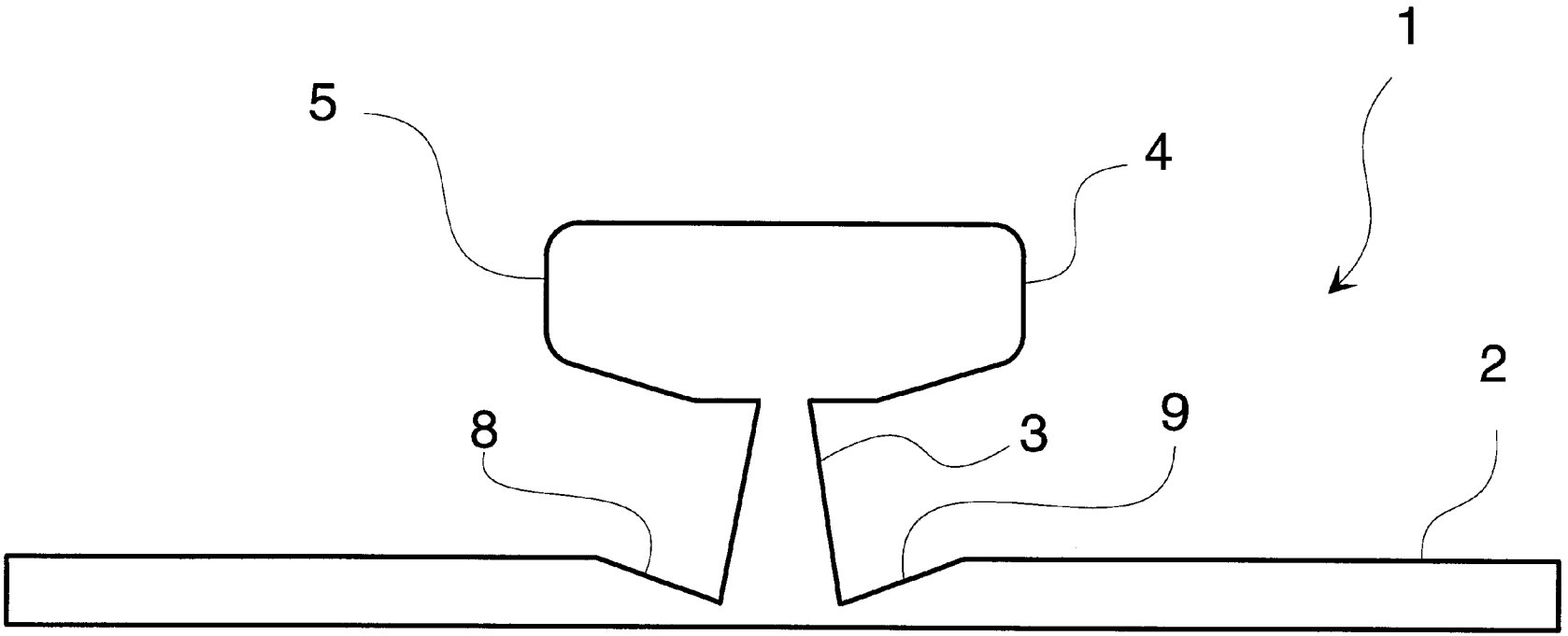
FIG. 8 illustrates one embodiment of the connector of the present invention.
Figure 9:
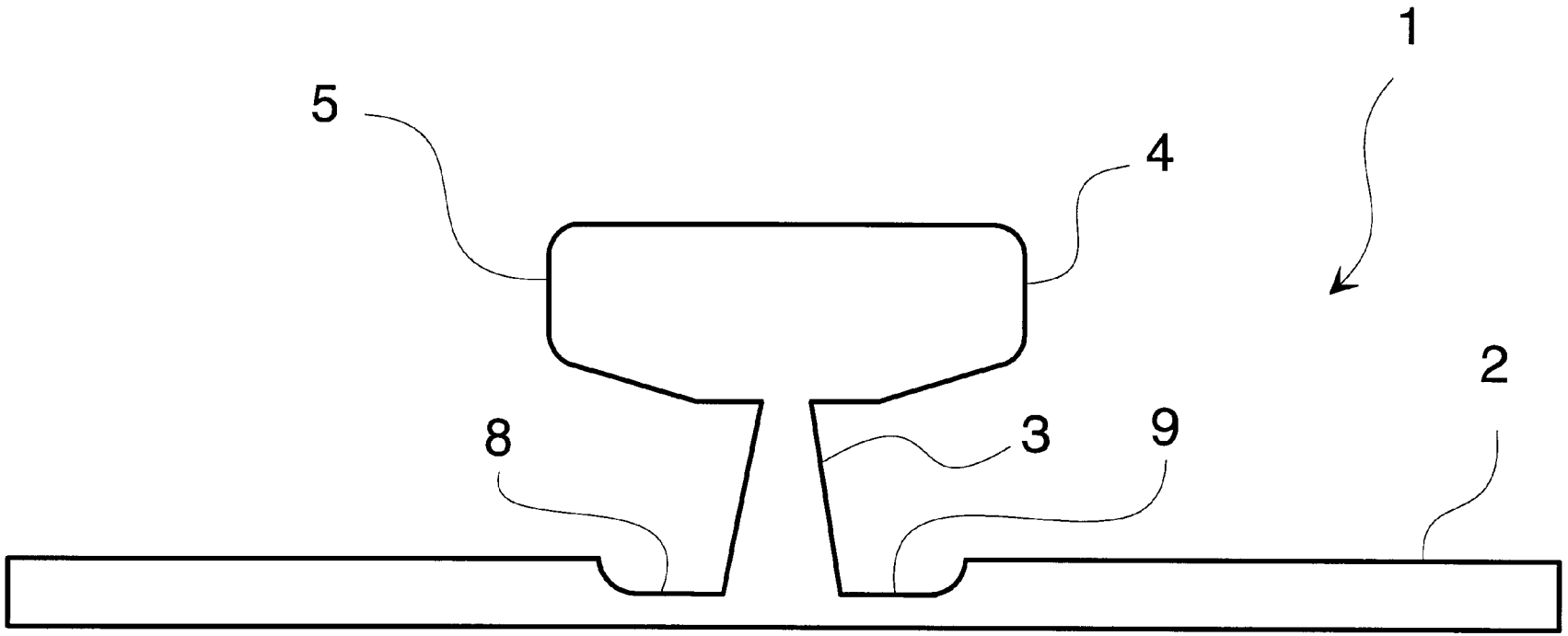
FIG. 9 illustrates one embodiment of the connector of the present invention.
Figure 10:
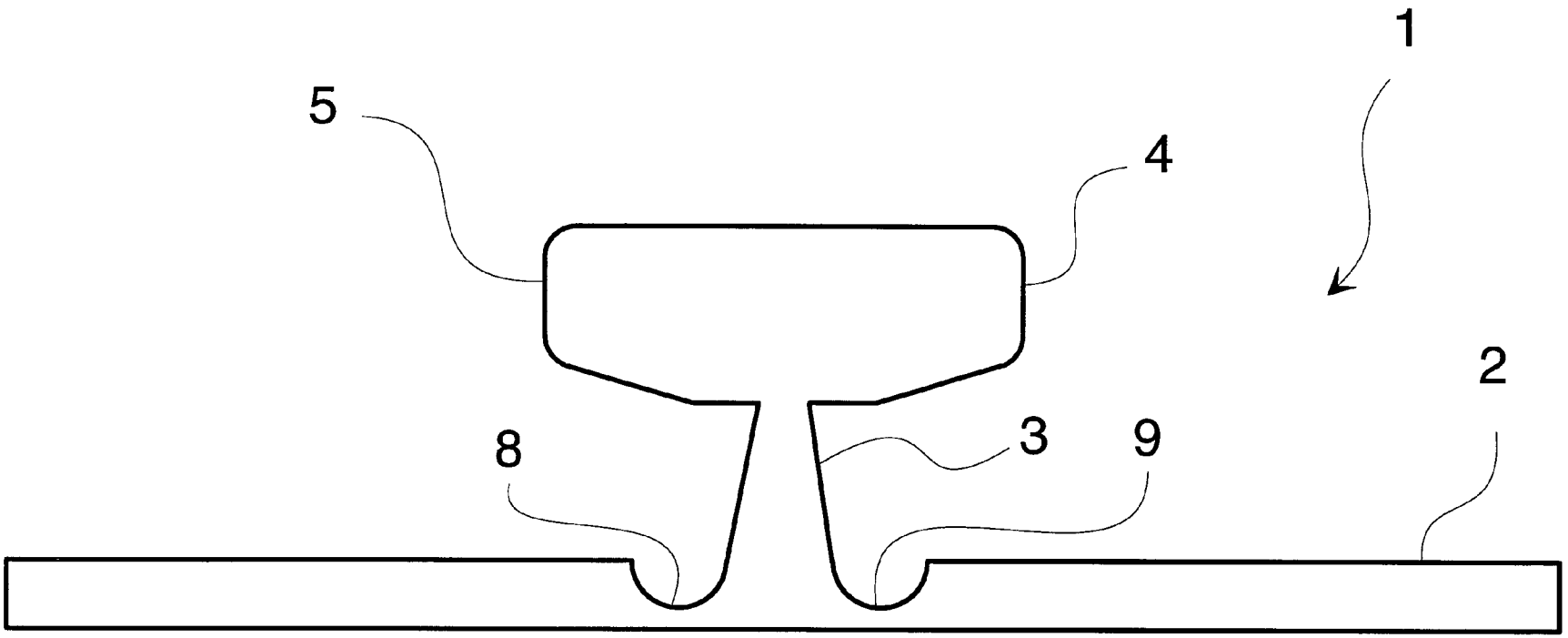
FIG. 10 illustrates one embodiment of the connector of the present invention.
Figure 11:
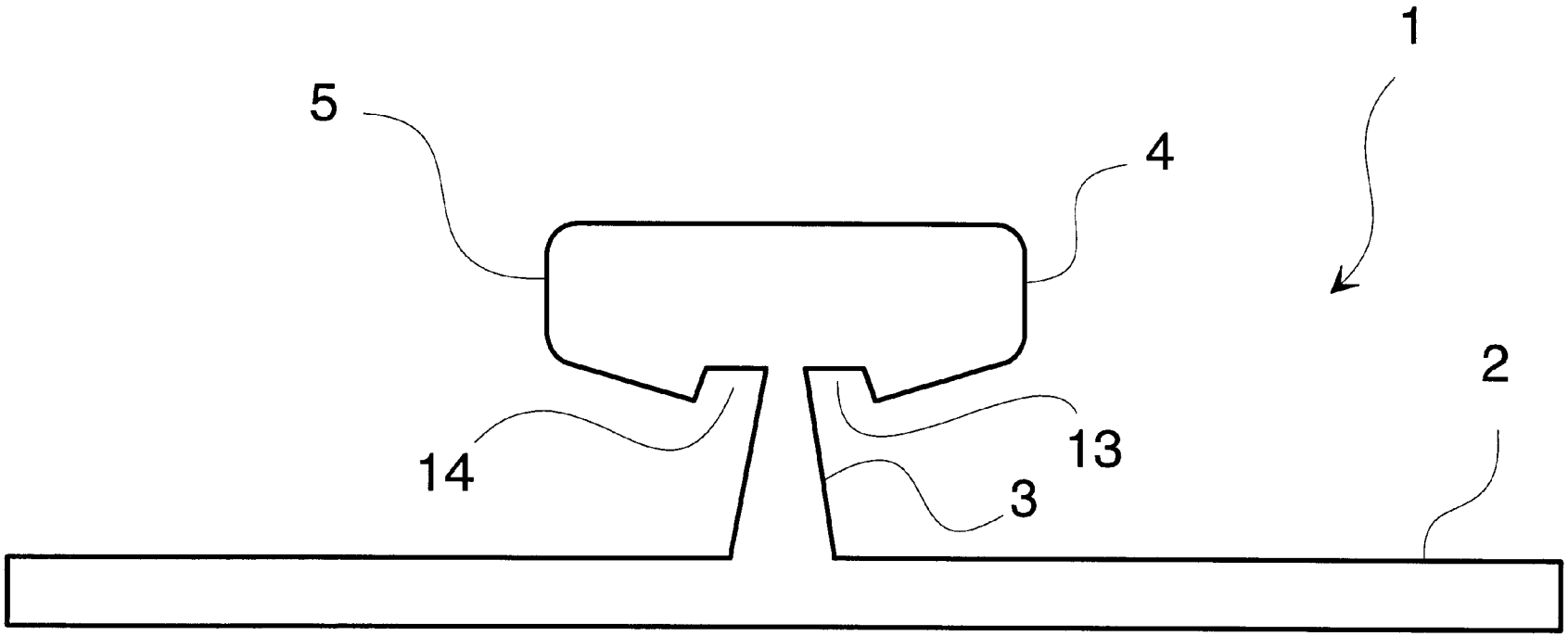
FIG. 11 illustrates one embodiment of the connector of the present invention.
Figure 12:
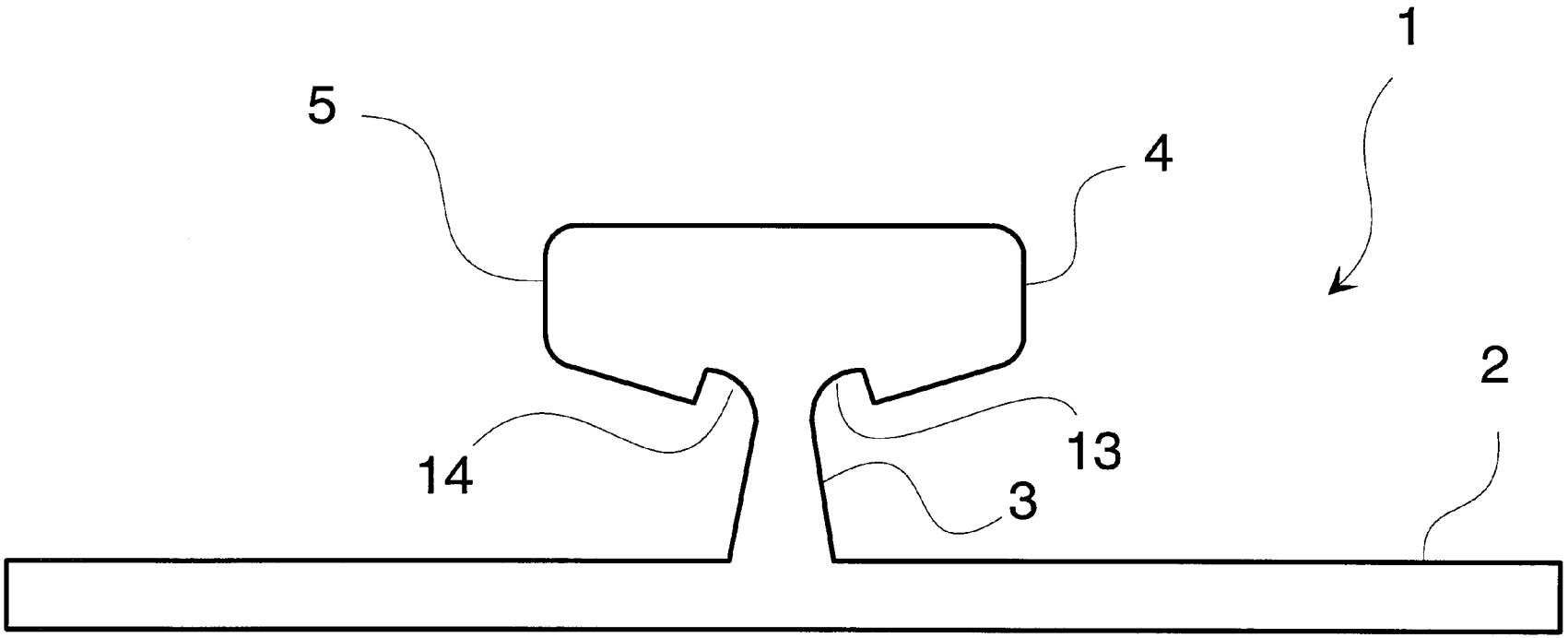
FIG. 12 illustrates one embodiment of the connector of the present invention.
Figure 13:
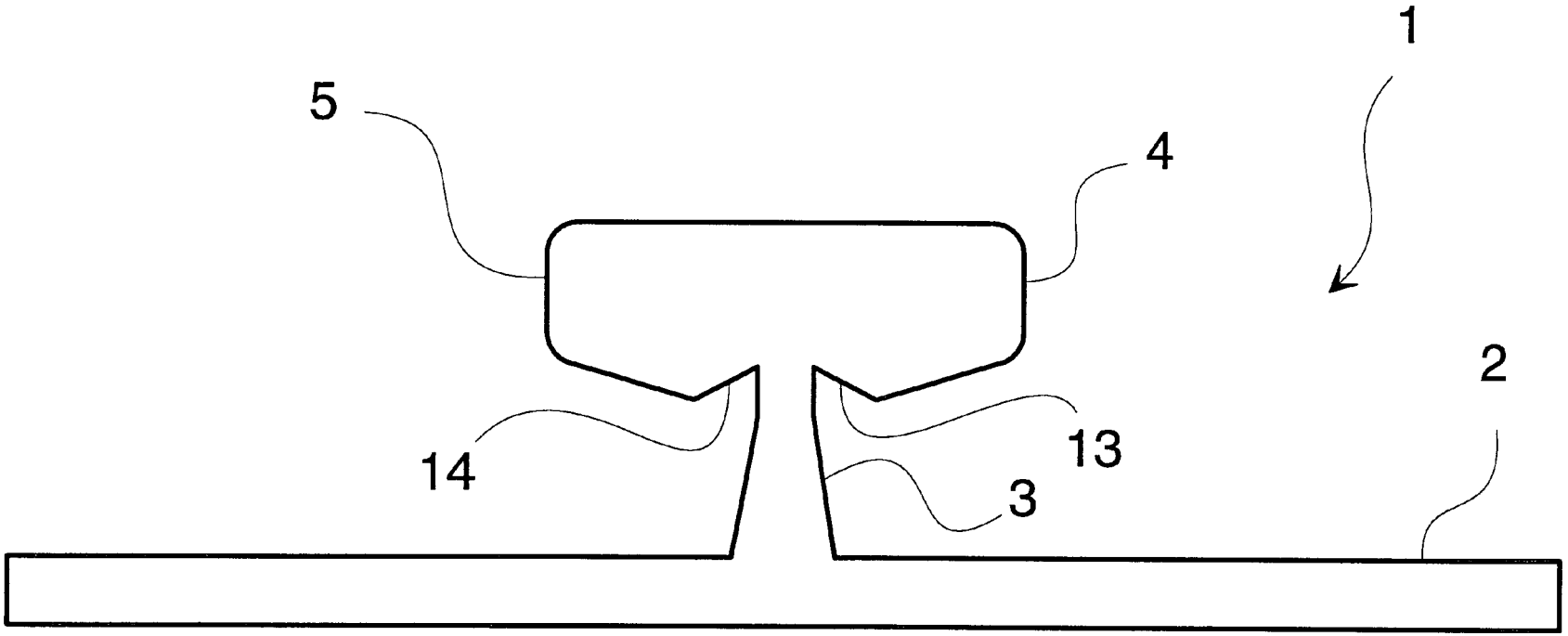
FIG. 13 illustrates one embodiment of the connector of the present invention.
Figure 14:
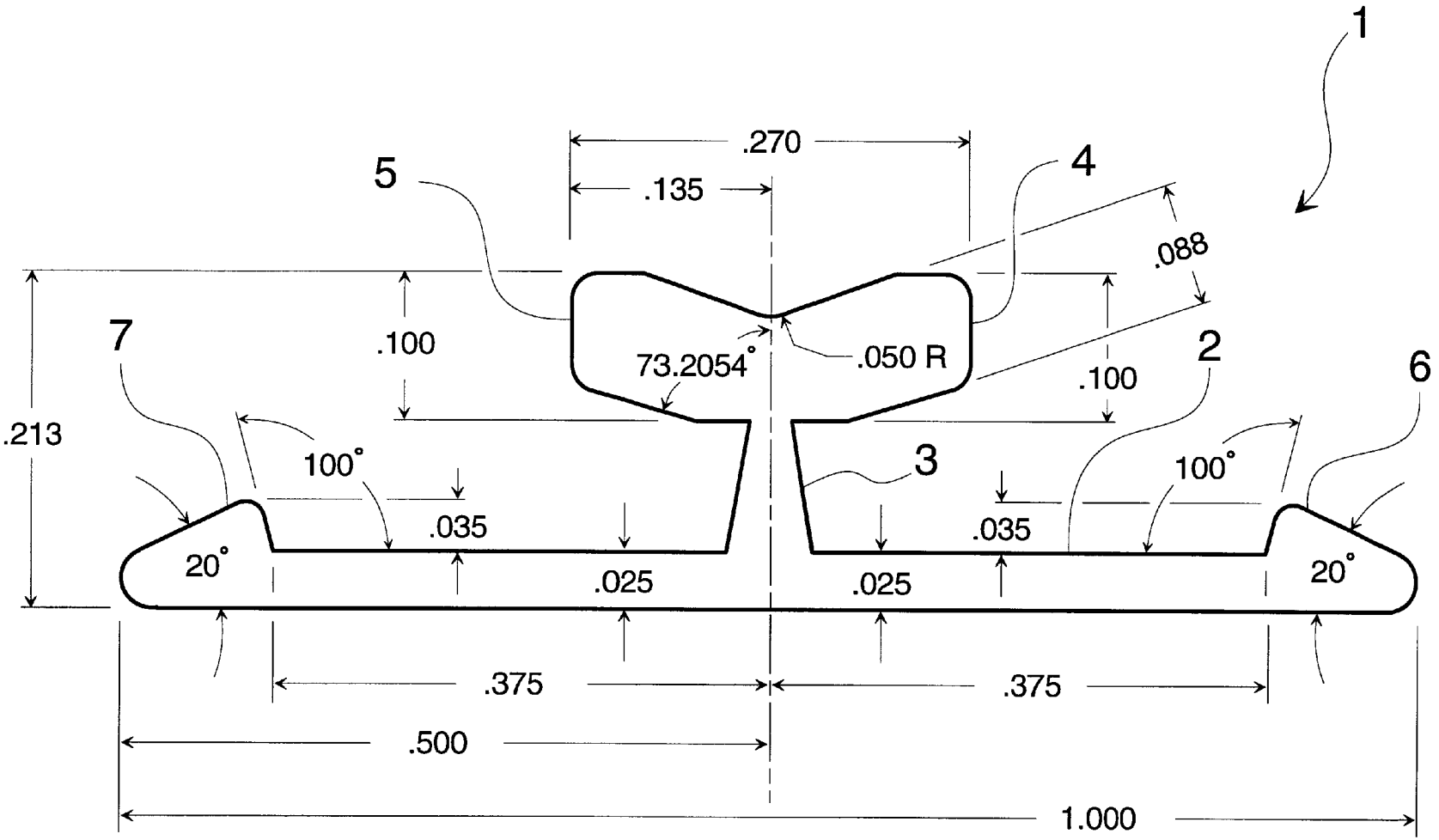
FIG. 14 illustrates a particularly preferred embodiment of the connector of the present invention (Scale 9×; 1.00=1 inch)
Figure 15:
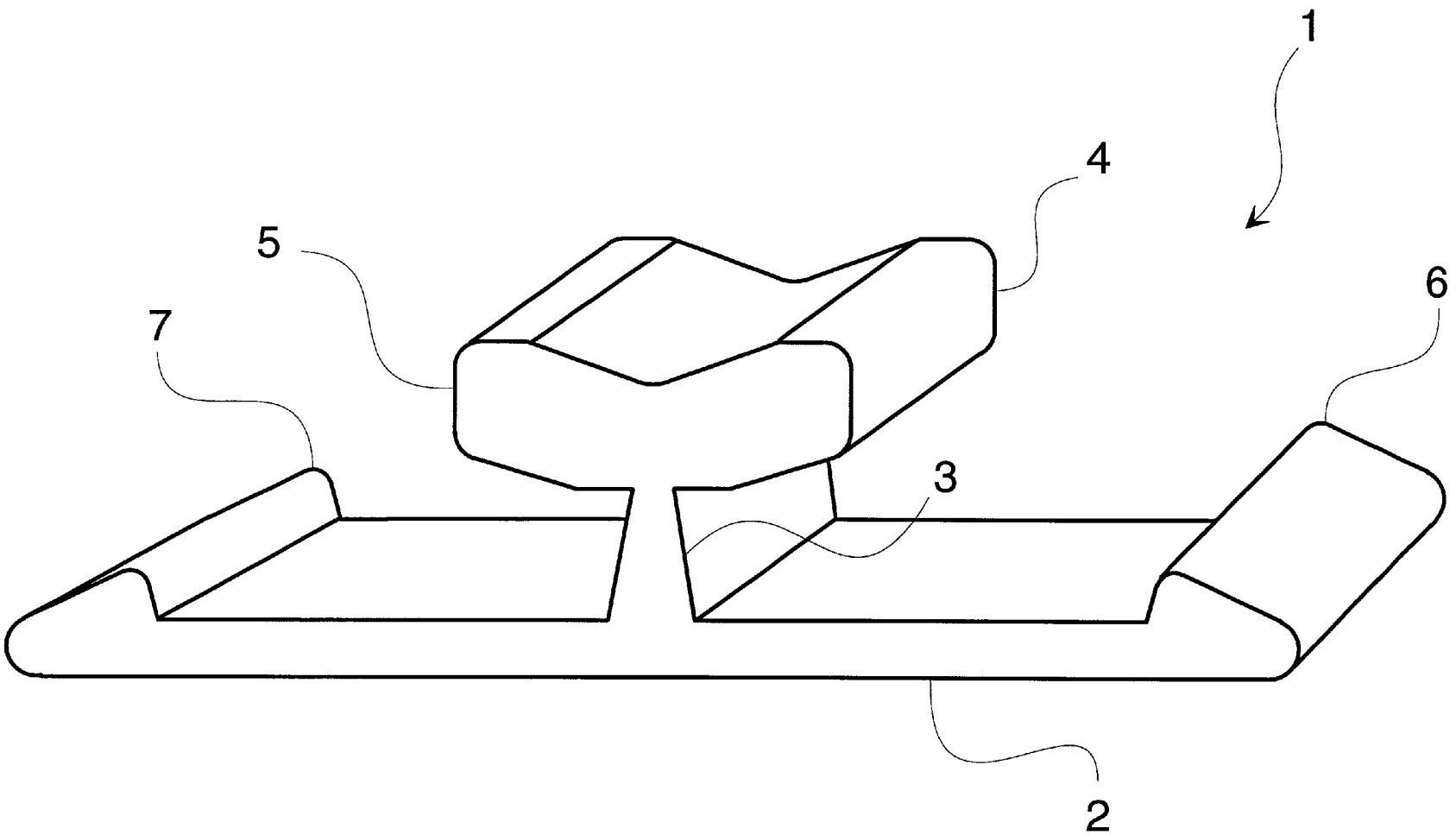
FIG. 15 illustrates a shaded view of a preferred embodiment of the connector of the present invention.
Figure 16:
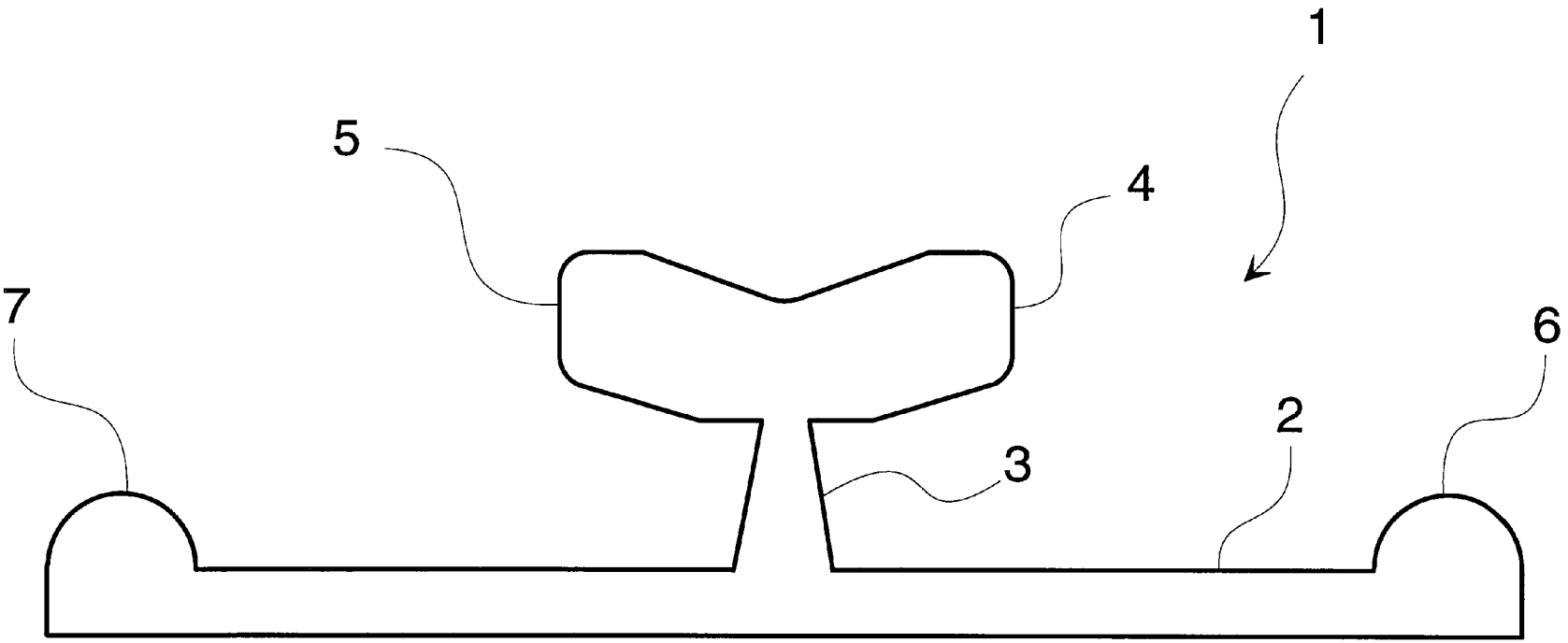
FIG. 16 illustrates one embodiment of the connector of the present invention.
Figure 17:
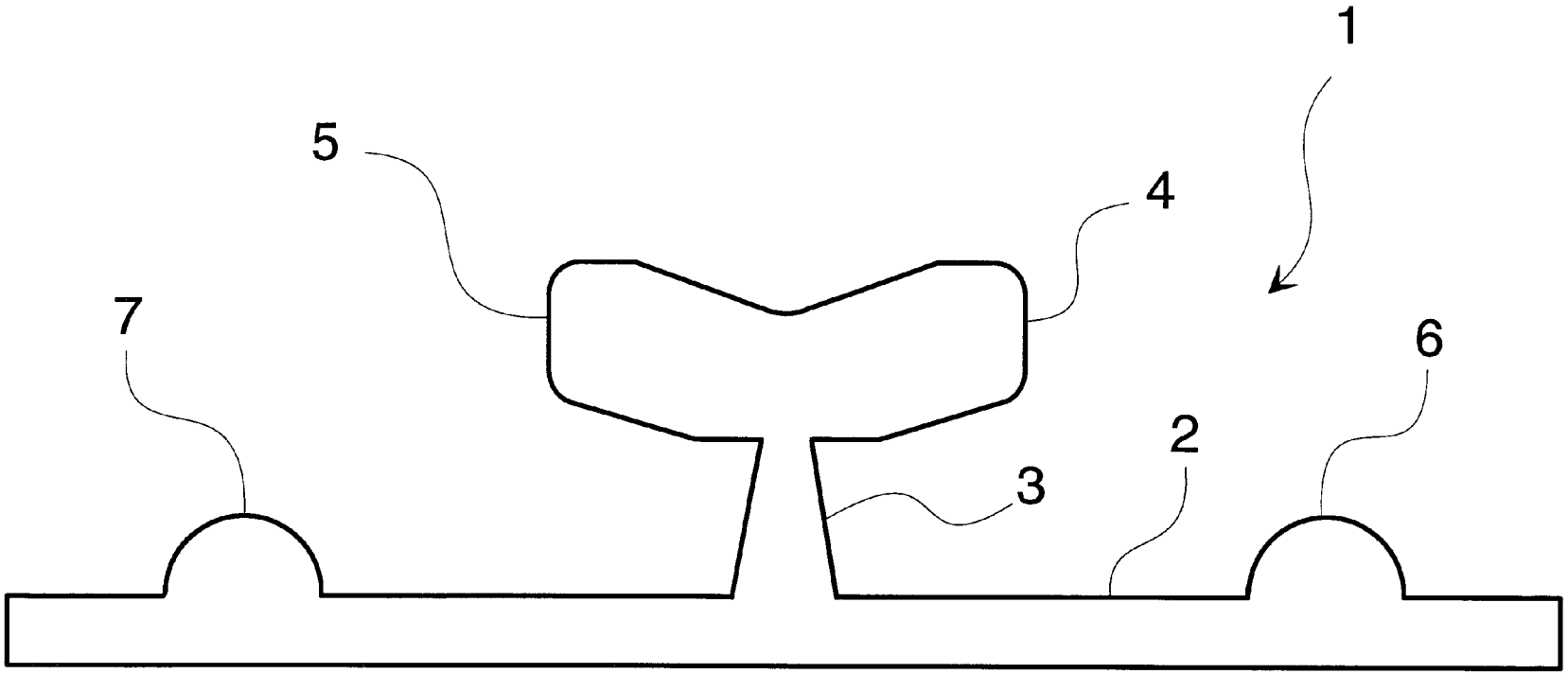
FIG. 17 illustrates one embodiment of the connector of the present invention.
Figure 18:
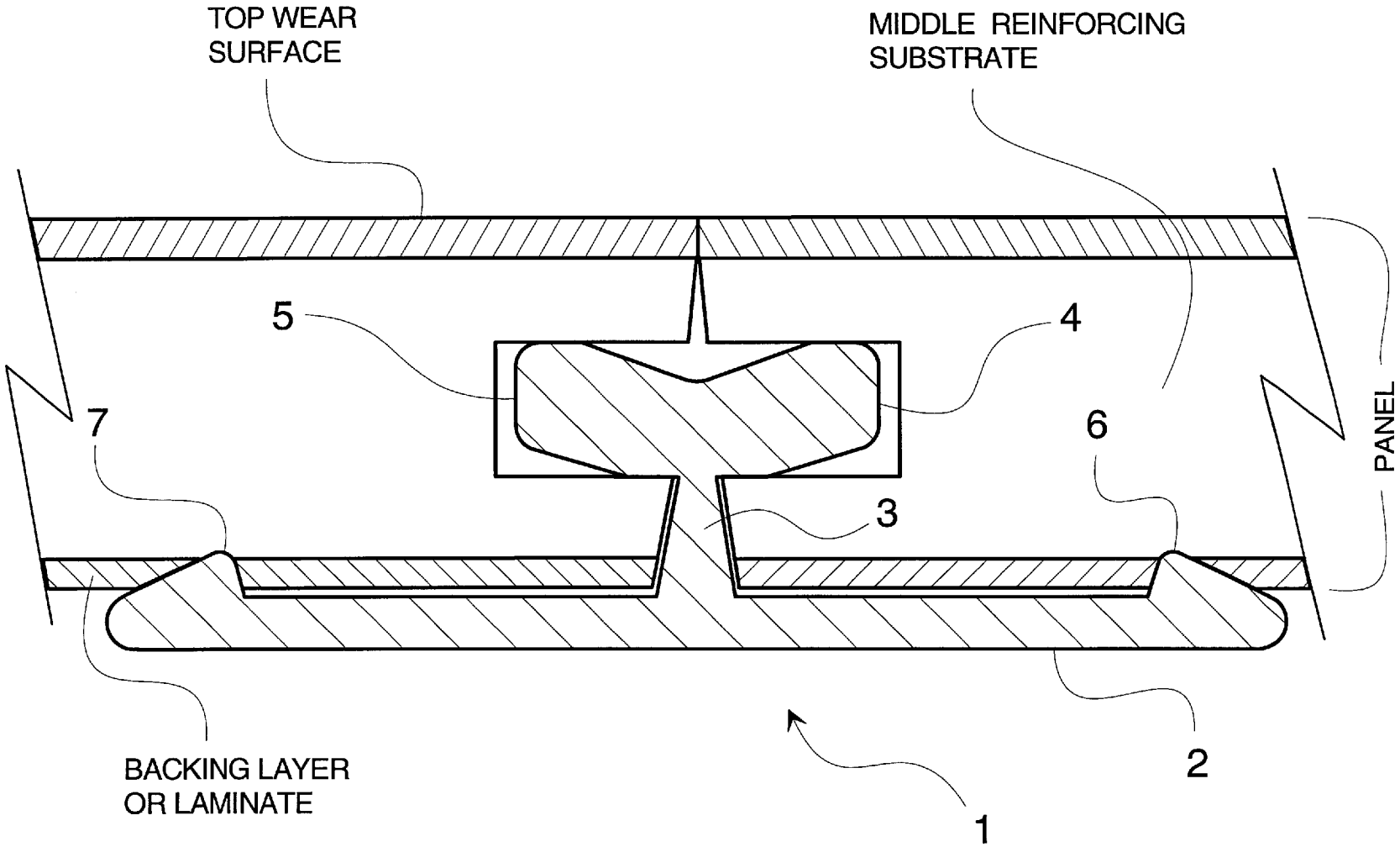
FIG. 18 illustrates a preferred embodiment of the connector of the present invention and a preferred embodiment of the panels of the present invention.

Referring now to FIG. 6, the preferred embodiment of connector 1 of the present invention is comprised of base 2, projection (collectively 3, 4 and 5), and protrusions 6 and 7 spaced apart from and on either side of the projection (collectively 3, 4 and 5) projecting vertically from base 2. Protrusions 6 and 7 are preferably rounded on the top portion as shown, and taper away, i.e., decrease in height as you move away from the center of the base toward the end of said base. Thus, the portion of the protrusions closest to the center of the base and projection (3, 4 and 5) extend the greatest distance vertically. A particularly preferred embodiment of the connector of the present inventive system is shown in FIG. 14. The scale of FIG. 14 is 9 times actual size, i.e., 1.000 equals 1.00 inch. It is also to be understood however, while not shown that base 2 of connector 1 may be constructed such that it does not touch the support structure, i.e., wherein the connector is fully encompassed by the two connecting panels.

I claim:

1. A disengageable interconnecting flooring system for use in forming a temporary or permanent laminate flooring surface on top of a support structure from individual flooring panels, said system comprising:

at least two laminate flooring panels and at least one connector;

the flooring panels comprising a top wear surface, a substrate material, and a bottom surface for contact with the support structure, each panel comprising at least one edge having a recess formed therein for receipt of a projection from said connector, and at least one channel formed in the bottom surface of each panel shaped for receipt of protrusions from said connector, the connector comprising a base having a projection extending vertically therefrom, said projection having a top surface and a bottom surface, at least one of said projection surfaces comprising at least one angled portion sloped in relation to said base, said projection shaped to be received in a disengageable vertical connected fashion into the recesses in the edges of said at least two panels, said base of said connector further comprising two protrusions extending vertically from either side of the base spaced from the projection, said protrusions shaped to be received in a disengageable horizontal connected fashion into the channels in said bottom surfaces of said panels, wherein when said at least two panels are connected using the connector, the resultant visible flooring surface consists of only the top wear surface of the panels.

2. The system of claim 1 wherein the thickness of the laminated flooring panels ranges from about 0.240 inches to about 0.320 inches.

3. The system of claim 1 wherein the substrate material of the panels is selected from the group of materials consisting of medium density fiberboard, high density fiberboard, wood/plastic compositions, woods, ceramics, unfilled plastics, filled plastics, and closed-cell rigid foams, and combinations thereof.

4. The system of claim 1 wherein the connector is composed of a material selected from the group consisting of metals, unfilled plastics, filled plastics, rubbers, ceramics, wood compositions, and combinations thereof.

5. The system of claim 1 wherein the recesses in the edges of the panels extend substantially the entire length of the edges.

6. The system of claim 1 wherein the channels in the panels extend substantially the entire length of the panels.

7. The system of claim 1 wherein the connector is of substantially the same length as said at least one edge of one of the panels.

8. The system of claim 1 wherein the projection of the connector extends substantially the entire length of the connector.

9. The system of claim 1 wherein the protrusions extend substantially the entire length of the connector.

10. The system of claim 1 wherein the distance from the base of the connector to an uppermost vertical portion of the first projection is less than the distance between the top wear surface and the bottom surface of the panels.

11. The system of claim 1 wherein the distance from the base of the connector to an uppermost vertical portion of the projection is less than about 0.240 inches.

12. The system of claim 1 wherein the projection includes a portion extending parallel to and spaced from the base of the connector and extending for substantially the entire length of the connector.

13. The system of claim 1 wherein the protrusions are in the shape of nodes extending substantially the entire length of the connector from the base and spaced from the projection.

14. The system of claim 1 wherein the projection is connected to the base of the connector via a support extending vertically from the base.

15. The system of claim 14 wherein the projection angularly extends from the support extending from the base.

16. The system of claim 15 wherein the projection further comprises a node extending therefrom.

17. The system of claim 1 wherein the base of the connector is shaped to rest on the support structure.

18. The system of claim 1 wherein the base of the connector further comprises recesses therein, and the edges of the panels are shaped to be received in a disengageable horizontal connected fashion into the recesses of the base of the connector.

19. The system of claim 1 wherein the projection of the connector further comprises recesses therein, and the edges of the panels are shaped to be received in a disengageable horizontal connected fashion in the recesses of said projection.

20. The system of claim 1 wherein the protrusions of the connector extend vertically a distance less than the projection.

21. The system of claim 1 wherein the connector is manufactured from metal.

22. The system of claim 1 wherein the connector is manufactured from plastic.

23. The system of claim 1 wherein the projection of the connector has right and left halves and said halves further comprise recesses therein.

24. The system of claim 1 wherein the base of the connector further comprises two recesses formed therein located between the protrusions and the projection.

25. The system of claim 1 wherein said connector is an elongated track.

26. The system of claim 1 wherein the protrusions of the connector each comprise a top surface, said top surface sloped away from the projection.

27. The system of claim 1 wherein the top surface of said projection comprises said at least one angled portion and wherein said at least one angled portion is sloped away from the base.

28. The system of claim 1 wherein the bottom surface of said projection comprises said at least one angled portion and wherein said at least one angled portion is sloped away from the base.

29. The system of claim 1 wherein the top and bottom surfaces of said projection each comprise at least one angled portion sloped away from the base.

30. The system of claim 1 wherein the protrusions have top surfaces sloped in one direction relative to the base and the at least one angled portion of the projection is sloped in an opposite direction relative to the base.

31. The system of claim 30 wherein the top surfaces of the protrusions are sloped toward the base and the at least one angled portion of the projection is sloped away from the base.

* * * * *